US011136232B2

(12) United States Patent
Park et al.

(10) Patent No.: US 11,136,232 B2
(45) Date of Patent: Oct. 5, 2021

(54) WATER DISCHARGE DEVICE AND METHOD FOR CONTROLLING THE SAME

(71) Applicant: LG Electronics Inc., Seoul (KR)

(72) Inventors: Jongho Park, Seoul (KR); Heesang Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/006,319

(22) Filed: Aug. 28, 2020

(65) Prior Publication Data

US 2021/0061638 A1 Mar. 4, 2021

(30) Foreign Application Priority Data

Aug. 30, 2019 (KR) ..... 10-2019-0107594

(51) Int. Cl.
*B67D 1/12* (2006.01)
*B67D 1/00* (2006.01)
*B67D 1/08* (2006.01)

(52) U.S. Cl.
CPC ..... *B67D 1/1236* (2013.01); *B67D 1/0003* (2013.01); *B67D 1/0882* (2013.01); (Continued)

(58) Field of Classification Search
CPC .. B67D 1/0882; B67D 1/0888; B67D 1/0895; B67D 1/1236; B67D 1/16; (Continued)

(56) References Cited

U.S. PATENT DOCUMENTS

2016/0106136 A1* 4/2016 Gordon ..... A47J 31/407 426/477
2016/0235242 A1* 8/2016 McHugh ..... A47J 31/407
(Continued)

FOREIGN PATENT DOCUMENTS

KR 20100091633 8/2010
KR 1020180088591 8/2018
(Continued)

OTHER PUBLICATIONS

PCT International Search Report in International Appln. No. PCT/KR2020/008850, dated Sep. 29, 2020, 13 pages.

*Primary Examiner* — Vishal Pancholi
*Assistant Examiner* — Bob Zadeh
(74) *Attorney, Agent, or Firm* — Fish & Richardson P.C.

(57) ABSTRACT

A water discharge device includes a case, a microphone, a voice recognition module, a speaker, a first elevation cover connected to the case, a second elevation cover configured to move upward and insert into an inside of the first elevation cover, an elevation motor connected to the second elevation cover, a water discharge nozzle disposed at a lower end of the second elevation cover, a water discharge valve configured to regulate water flow toward the water discharge nozzle, a flow sensor configured to sense a flow rate of the water flow, a sensor disposed at the second elevation cover and configured to, based on the second elevation cover moving downward, sense whether the sensor contacts a container disposed below the second elevation cover, and a controller configured to control operation of the elevation motor and the water discharge valve.

20 Claims, 16 Drawing Sheets

(52) U.S. Cl.
CPC ..... *B67D 2001/0093* (2013.01); *B67D 2210/00065* (2013.01)

(58) Field of Classification Search
CPC .. B67D 2001/0093; B67D 2210/00031; B67D 2210/00039; B67D 2210/00044; B67D 2210/00049; B67D 2210/00062; B67D 2210/00065; B67D 2210/00094; B67D 2210/00118; Y02W 30/80
See application file for complete search history.

(56) References Cited

U.S. PATENT DOCUMENTS

| | | | | |
|---|---|---|---|---|
| 2017/0231431 | A1 | 8/2017 | Maeng | |
| 2018/0174207 | A1* | 6/2018 | Potucek | G06Q 30/0283 |
| 2019/0377973 | A1* | 12/2019 | Jin | B67D 1/0014 |
| 2020/0039808 | A1 | 2/2020 | Jeong | |
| 2020/0377356 | A1 | 12/2020 | Kim et al. | |
| 2021/0061638 | A1* | 3/2021 | Park | B67D 1/08 |

FOREIGN PATENT DOCUMENTS

| | | |
|---|---|---|
| KR | 1020180119310 | 11/2018 |
| KR | 1020190085773 | 7/2019 |
| KR | 1020190092327 | 8/2019 |

* cited by examiner

WATER DISCHARGE DEVICE AND METHOD FOR CONTROLLING THE SAME

CROSS-REFERENCE TO RELATED APPLICATION

This application claims a benefit under 35 U.S.C. § 119(a) of Korean Patent Application No. 10-2019-0107594, filed on Aug. 30, 2019, the entire disclosure of which is incorporated herein by reference for all purposes.

TECHNICAL FIELD

The present disclosure relates to a water discharge device and a method for controlling the same.

BACKGROUND

Water discharge devices such as water purifiers, refrigerators, coffee machines, and the like may filter water supplied from a water supply source by using physical and chemical methods to remove impurities and then supply the purified water.

Water discharge devices may be classified into natural filtration-type water purifiers, direct filtration-type water purifiers, ion exchange resin-type water purifiers, distillation-type water purifiers, reverse osmotic pressure-type water purifiers, and the like according to purification principles or manners.

The water discharge devices may be used for household purposes as mechanisms that filter water to remove impurities.

For example, household water discharge devices may include water discharge devices that are connected to a water supply system to remove floating matters or harmful components contained in tap water and that purify the tap water as much water as desired by user's manipulation to dispense the purified water.

In some examples, the water discharge devices may be capable of dispensing hot water and cold water as well as purified water. In some cases, the water discharge devices may have small size to be installed in various installation environments.

In some cases, a water discharge device may mainly supply water in a manual manner in which a water supply button is pressed after a cup or container, which intends to receive water, is placed below a water discharge nozzle. In such cases, the user checks that a desired amount of water is dispensed in a state in which the use holds the cup and then stop the operation of pressing the water supply button.

For instance, the user may continuously check an amount of water until the desired amount of water is dispensed. If the user is distracted for a moment during the dispensing, the water exceeding the capacity of the cup may be discharged, and thus, the water may overflow around the water discharge device. In some cases, when hot water is dispensed, the user's hand may be burned.

In some cases, a water discharge device may include an automatic water discharging button to dispense a predetermined amount of water when the button is pressed and released. In such cases, if a size and shape of the cup is not considered, the water discharge button may need to be pressed several times to fully fill the water in the cup because an amount of water intake per one time may be insufficient to fill the cup.

In some cases, when a flow rate desired by the user is set, water may be discharged according to the set flow rate. For example, in a state in which the user set a flow rate of water to about 50 ml, when the user presses the water discharge button, only about 50 ml of water may be discharged.

In some cases, since water having a constant flow rate may be provided as described above regardless of the size and height of the cup, there is a cumbersome of pressing the water discharge button several times so as to receive water into a large cup having a capacity of about 500 ml.

In some cases, the user may operate a button for controlling an amount of water to be discharged, and then operate a button for commanding the water discharge, i.e., two manipulations may be performed to discharge water to an amount of water to receive the desired amount of water. In some cases, a greater number of times of button manipulations may be needed to accurately control discharge of a large amount of water.

SUMMARY

The present disclosure describes a water discharge device that may be easily manipulated by voice to dispense a desired amount of water having a desired temperature, and a method for controlling the same.

For example, the desired water discharge amount may be input by voice through voice recognition to improve a process in setting the water discharge amount.

In some implementations, the amount of water desired by a user may be discharged without pressing a water discharge button once.

In some implementations, the water discharge device may include a water discharge nozzle that may dispense water and that may automatically move vertically by an operation of an elevation motor.

In some implementations, the water discharge device may be rotatable and movable vertically and horizontally to improve user's convenience.

In some implementations, the water discharge device may include a water discharge portion that is automatically elevatable and manually rotatable to left and right sides.

In some implementations, the water discharge device may be capable of more sensitively sensing heights and widths of various containers placed below a water discharge nozzle and a method for controlling the same.

In some implementations, the water discharge device may include a water discharge nozzle that may be adjusted a height to avoid a water splash phenomenon occurring by a height difference between a water discharge nozzle and a water intake container, thereby reducing contamination of the water discharge nozzle and improving sanitation.

In some implementations, the water discharge device may help a user to avoid a burn due to water splashing during hot water, thereby improving safety of the user.

According to one aspect of the subject matter described in this application, a water discharge device includes a case that includes a front cover defining a front surface of the case, a microphone configured to receive a sound input from a user, a voice recognition module configured to recognize voice information from the sound input, a speaker configured to output a guide sound to the user, a first elevation cover connected to the case, a second elevation cover configured to move upward relative to a bottom of the case and insert into an inside of the first elevation cover, an elevation motor connected to the second elevation cover and configured to provide power for operation of the second elevation cover, a water discharge nozzle disposed at a lower end of the second elevation cover and configured to dispense water, a water discharge valve configured to regulate a flow of water guided toward the water discharge nozzle, a flow sensor configured to sense a flow rate of the flow of water guided toward the water discharge nozzle, a sensor that is disposed at the second elevation cover and has at least a portion exposed to a lower side of the second elevation cover, where the sensor is configured to, based on the second elevation cover moving downward toward the bottom of the case, sense whether the sensor contacts a container disposed below the second elevation cover, and a controller configured to control operation of the elevation motor and the water discharge valve.

Implementations according to this aspect may include one or more of the following features. For example, the controller may be configured to stop operation of the elevation motor based on the sensor contacting the container while the second elevation cover moving downward toward the bottom of the case. In some examples, the controller may be configured to, based on the sensor contacting the container while the second elevation cover moving downward toward the bottom of the case, control the elevation motor to move the second elevation cover upward to a set height, and control the elevation motor to stop operation of the second elevation cover based on the second elevation cover being moved upward to the set height.

In some implementations, the case may further include a top cover that defines a top surface of the case, where the voice recognition module, the speaker, and the microphone may be disposed vertically below the top cover. In some examples, the voice recognition module may be disposed adjacent to the front cover, the microphone may be disposed rearward relative to the voice recognition module, and the speaker may be disposed between the voice recognition module and the microphone.

In some implementations, the controller may be configured to control the operation of the elevation motor to move the second elevation cover between a preset top dead point and a preset bottom dead point. In some examples, the controller may be configured to output the guide sound through the speaker based on a determination that the sensor does not contact the container in a state in which the second elevation cover is at the preset bottom dead point. In some examples, the controller may be configured to decrease a rotation rate of the elevation motor based on the second elevation cover approaching the preset top dead point or the preset bottom dead point.

In some implementations, the voice recognition module may be configured to communicate with an external server, and to terminate communication with the external server based on communicating with the external server for a set time. In some examples, the voice recognition module may be configured to determine a desired water discharge amount from the voice information, and, based on the desired water discharge amount being less than a reference amount corresponding to the container, maintain the communication with the external server. In some examples, the voice recognition module may be configured to determine a desired water discharge amount from the voice information, and, based on the desired water discharge amount being greater than or equal to a reference amount corresponding to the container, terminate the communication with the external server after communicating with the external server for the set time.

According to another aspect, a method for controlling a water discharge device described above includes receiving the sound input from the user through the microphone, recognizing the voice information from the sound input, recognizing an input wakeup word from the voice information, and outputting a wakeup word recognition guide sound through the speaker, recognizing a desired water discharge amount from the voice information, and outputting a desired water discharge condition recognition guide sound through the speaker, moving the second elevation cover downward toward the bottom of the case by operating the elevation motor, detecting whether the sensor contacts an upper end of the container, stopping operation of the elevation motor to stop a downward movement of the second elevation cover, opening the water discharge valve to discharge water, and closing the water discharge valve to terminate discharge of water based on an amount of discharged water corresponding to the desired water discharge amount, the amount of discharged water being determined based on the flow rate detected by the flow sensor.

Implementations according to this aspect may include one or more of the following features. For example, the method may further include controlling the elevation motor to move the second elevation cover between a preset top dead point and a preset bottom dead point, where opening the water discharge valve to discharge water may include determining whether the sensor contacts the upper end of the container based on the second elevation cover being positioned at the preset bottom dead point, comparing the desired water discharge amount with a reference amount corresponding to the container, and based on (i) a determination that the sensor does not contact the upper end of the container and (ii) the desired water discharge amount being less than the reference amount, opening the water discharge valve to discharge water.

In some implementations, the method may include controlling the elevation motor to move the second elevation cover between a preset top dead point and a preset bottom dead point, where closing the water discharge valve may include determining whether the sensor contacts the upper end of the container based on the second elevation cover being positioned at the preset bottom dead point, comparing the desired water discharge amount with a reference amount, based on (i) a determination that the sensor does not contact the upper end of the container and (ii) the desired water discharge amount being greater than or equal to the reference amount, maintaining a closed state of the water discharge valve.

In some implementations, the method may include, based on recognizing an emergency stop command from the voice information while discharging water through the water discharge nozzle, closing the water discharge valve. In some implementations, the method may include, based on recognizing a repeated water discharge command from the voice information while discharging water or at a time point at which water discharge is terminated, maintaining an open state of the water discharge valve to dispense additional water corresponding to the repeated water discharge command after dispensing the desired water discharge amount of water.

In some implementations, the method may include comparing the desired water discharge amount with a reference amount corresponding to the container, and, based on the desired water discharge amount being greater than or equal to the reference amount, outputting the guide sound through the speaker.

In some implementations, the method may include recognizing a desired water discharge temperature.

In some implementations, the method may include storing information including a desired water discharge use, a water discharge amount corresponding to the desired water discharge use, and a water temperature corresponding to the desired water discharge use, determining whether the voice information includes the desired water discharge use, and based on a determination that the voice information includes the desired water discharge use, dispensing the stored water discharge amount of water having the stored water temperature corresponding to the desired water discharge use.

In some implementations, the method may include comparing the desired water discharge amount with a reference amount corresponding to the container, based on the desired water discharge amount being less than the reference amount, outputting a first guide sound through the speaker, and, based on the desired water discharge amount being greater than the reference amount, outputting, through the speaker, a second guide sound that is different from the first guide sound.

DETAILED DESCRIPTION

Figure 1:
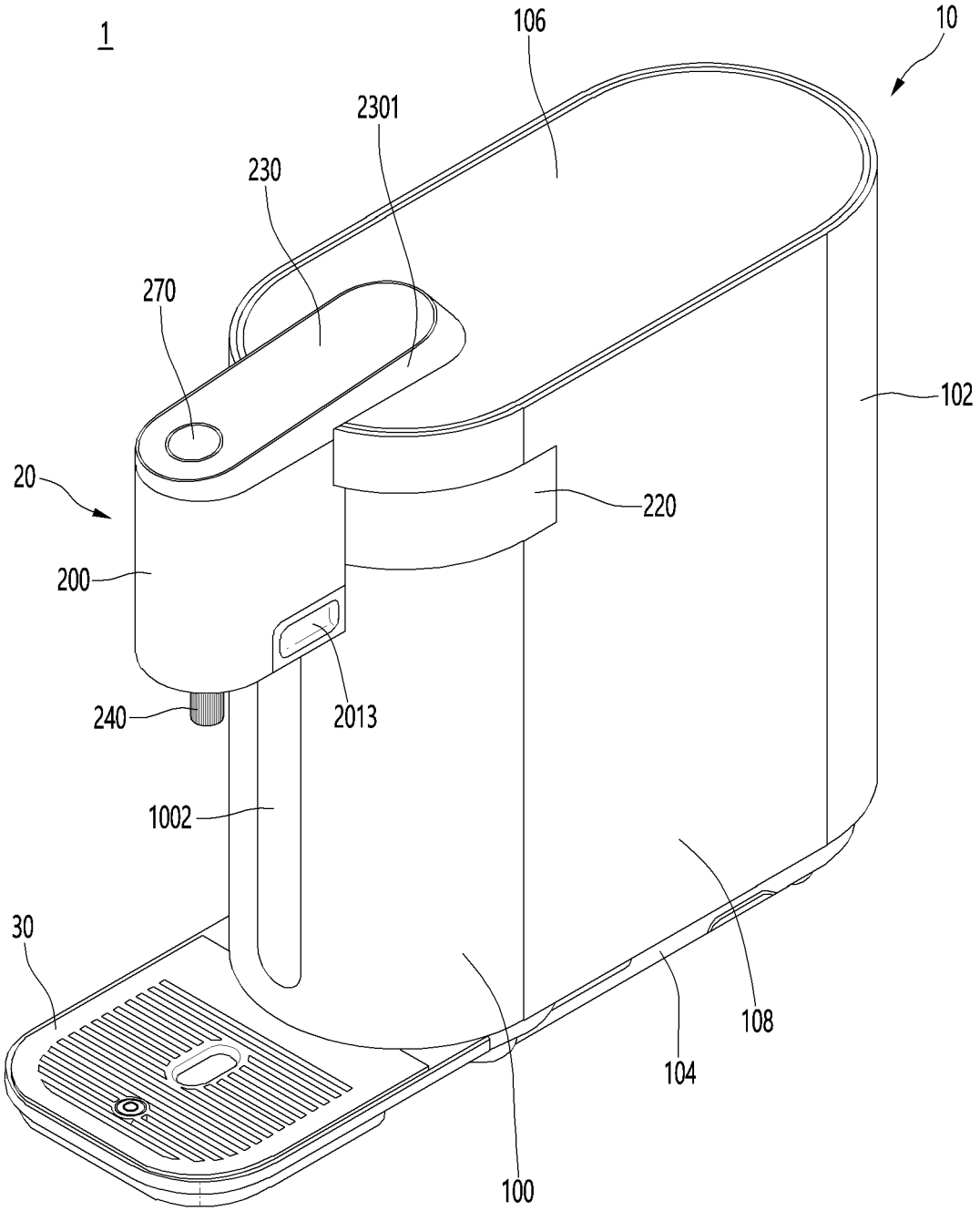
FIG. 1 is a view illustrating an example of a water discharge device.

Hereinafter, some implementations of the present disclosure will be described in detail with reference to the accompanying drawings. It is noted that the same or similar components in the drawings are designated by the same reference numerals as far as possible even if they are shown in different drawings. In the following description of the present disclosure, a detailed description of known functions and configurations incorporated herein will be omitted to avoid making the subject matter of the present disclosure unclear.

FIG. 1 illustrates an example of a water discharge device.

In the following description, a water discharge device may include a variety of water discharge devices, which supply water in a drinkable state from raw water. For example, the water discharge device may include water purifiers, drinking water dispensing machine, coffee machines, and the like.

In some implementations, as illustrated in FIG. 1, a water discharge device 1 may include a case 10 defining an outer appearance and a water discharge unit 20 coupled to one side of the case 10.

The case 10 may have an internal space in which various components to be described later are installed. For example, the case 10, as illustrated in FIG. 1, may be provided in a cylindrical shape. However, this is an exemplary shape, and the case 10 may be provided in various shapes.

The case 10 may be provided by coupling a plurality of plates to each other. In detail, the case 10 includes a front cover 100, a rear cover 102, a base cover 104, a top cover 106, and a pair of side covers 108. Here, each cover may define outer appearances of front, rear, bottom, top, and both side surfaces of the water discharge device 1.

The covers may be coupled to each other through a coupling member or coupling structure. In detail, the front cover 100 and the rear cover 102 are disposed to be spaced forward and backward from each other. In some examples, the pair of side covers 108 may connect the front cover 100 to the rear cover 102 to define a circumference of the water discharge device 1.

In some examples, the top cover 106 is coupled to upper ends of the front cover 100, the rear cover 102, and the pair of side covers 108. In some examples, the base cover 104 is coupled to lower ends of the front cover 100, the rear cover 102, and the pair of side covers 108. The base cover 104 is understood as a portion that is seated on a bottom surface on which the water discharge device 1 is installed.

Here, each of the front cover 100 and the rear cover 102 may be bent at a predetermined curvature, and each of the pair of side covers 108 may be provided as a flat plate. In detail, the front cover 100 and the rear cover 102 may be convex in front and rear directions, respectively.

In addition, front and rear ends of the front cover 100 and the top cover 106 are round to correspond to the front cover 100 and the rear cover 102, respectively.

Here, a plane portion 1002 may be disposed in the vertical direction at a central portion of the front cover 100. The plane portion 1002 may function as a center point when the water discharge unit 20 to be described later rotates.

In some examples, the plane portion 1002 may be understood as a recessed portion in the front cover 100 convexly protruding forward. Here, a front surface of the front cover 100 corresponds to a portion at which the user locates a container such as a cup (hereinafter, referred to as a water intake container) into which water is contained. As a result, the plane portion 1002 may be provided so that the user locates the water intake container more deeply, and thus, the water intake container may be stably supported.

In some examples, the water discharge device 1 includes a tray 30 on which the water intake container is seated. The tray 30 is connected to the base cover 104 to protrude forward. Thus, the tray 30 may be understood as forming a bottom surface of the water discharge device 1 together with the base cover 104.

In some examples, the tray 30 may be disposed vertically below a water discharge nozzle 240 to be described later. In some examples, the tray 30 may be provided as a structure for storing water that is not accommodated in the water intake container but falls down. For example, the tray 30 may be provided in a shape in which a grill and a storage portion, which is disposed below the grill, are provided.

The water discharge unit 20 may be coupled to protrude on one side of the case 10. In detail, the water discharge unit 20 may be disposed to protrude forward from the front cover 100 and the top cover 106. In some examples, the water discharge unit 20 is coupled to communicate with the case 10.

The water discharge unit 20 includes a water discharge top cover 230, water discharge elevation covers 200 and 210, and a rotator 220. Each of the covers may define an outer appearance of the water discharge unit 20.

Figure 3:
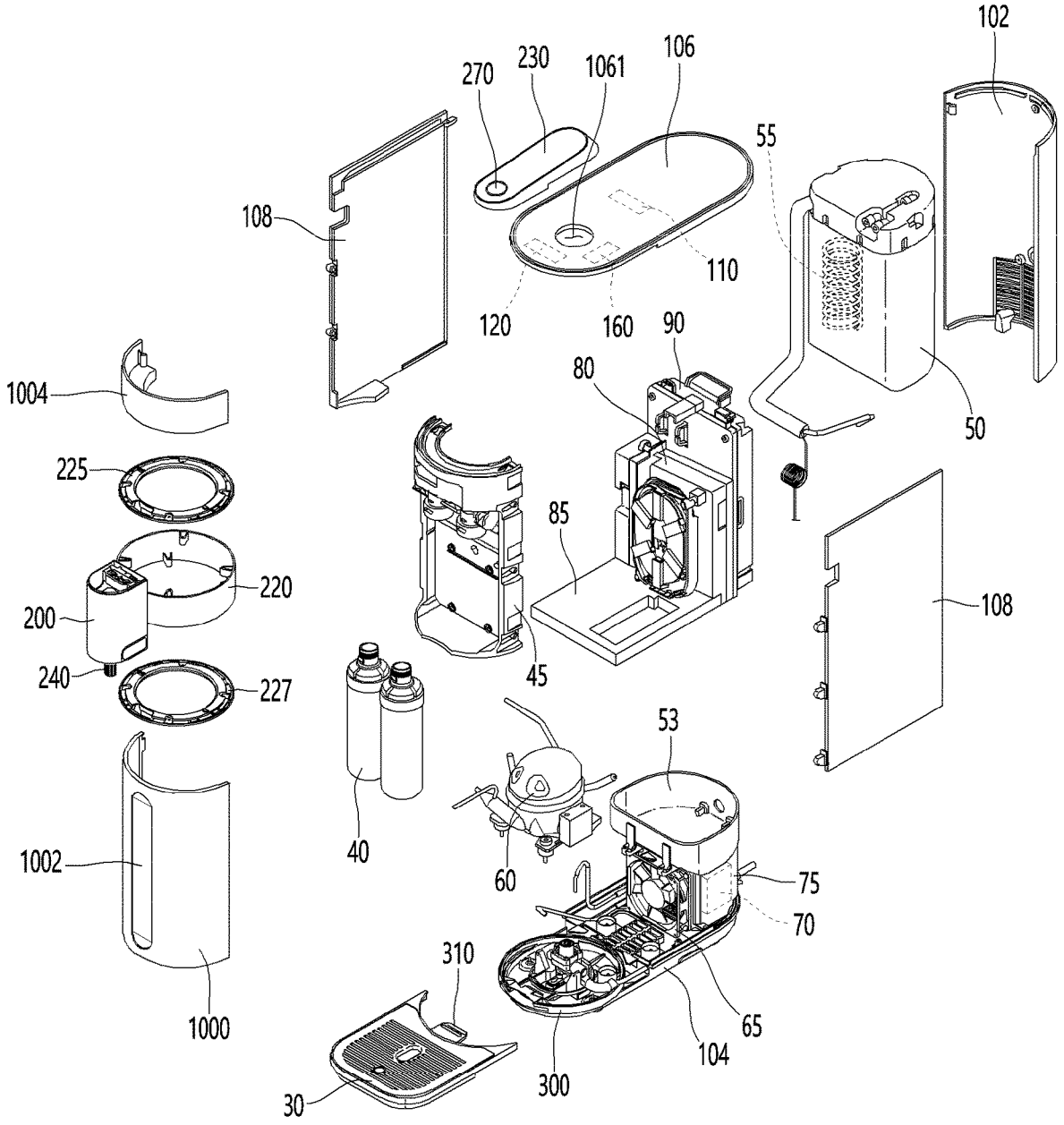
FIG. 3 is an exploded view of the water discharge device.

The rotator 220 corresponds to a constituent seated on the case 10. Referring to FIG. 3 to be described later, the rotator 220 is provided in a cylindrical shape corresponding to a curvature of the front cover 100. In some examples, the rotator 220 is disposed so that the front cover 100 is divided into upper and lower portions. Thus, the front cover 100 is divided into a lower front cover 1000 coupled to the base cover 104 and an upper front cover 1004 coupled to the top cover 106.

Here, the upper front cover 1004 has a cross-sectional area less than that of the lower front cover 1000. Thus, the upper front cover 1004 is understood as an auxiliary portion for defining the outer appearance. The lower front cover 1000 is understood as a portion on which the plane portion 1002 is disposed and which is disposed at one side of the water intake container.

In some examples, the water discharge elevation covers 200 and 210 are disposed to protrude forward from the front cover 100. In some examples, the rotator 220 may have a shape protruding outward. In addition, the water discharge top cover 230 is provided to extend from the top cover 106 and cover upper ends of the water discharge covers 200 and 210.

The water discharge top cover 230 may be provided with various input portions 270 through which a user inputs a predetermined command. The input portion 270 may be provided in various shapes such as a button manner and a touch manner. In some examples, although one input portion 270 is illustrated in FIG. 1, the input portion 270 may be provided in plurality.

The water discharge top cover 230 may include a sidewall portion 2301. The sidewall portion 2301 may have one side that is rotatably coupled to the top cover 106 and the other side that is coupled to upper portions of the first and second elevation covers 200 and 210.

In the sidewall portion 2301, the one side which is coupled to the top cover 106 may have a height greater than that of the other side coupled to the upper portions of the first and second elevation covers 200 and 210.

Thus, the water discharge top cover 230 may be spaced apart from the top cover 103 by the sidewall portion 2301, and the water discharge top cover 230 may be provided in a shape that is inclined downward from the case 10 in a direction of the water discharge unit 20. Thus, readability of the input portion 270 and a display portion may be improved.

A wire hole 1061 (see FIG. 3) may be defined in the top cover 106. In some examples, various wires may pass through the wire hole 1061 and then be connected to the input portion 270 and the display portion.

The water discharge top cover 230 and the sidewall portion 2301 may rotate with respect to the wire hole 1061 while being supported to contact the wire hole 1061. As described above, when the water discharge top cover 230 and the sidewall portion 2301 rotate, wire twisting may be reduced.

In some examples, the water discharge unit 20 may include a water discharge nozzle 240 through which a predetermined amount of water is dispensed. The water discharge nozzle 240 is installed to extend downward and may be disposed to be exposed to the lower portions of the water discharge cover 200 and 210. As described above, the tray 30 is disposed vertically below the water discharge nozzle 240.

In some examples, a water discharge pipe may be connected to the water discharge nozzle 240 and disposed inside the water discharge unit 20. The water discharge pipe may extend from the inside of the case 10 to the inside of the water discharge unit 20 and be coupled to the water discharge nozzle 240.

Here, the water discharge unit 20 of the water discharge device 1 may move so that the position of the water discharge nozzle 240 is changed. Hereinafter, this will be described in detail.

Figure 2:
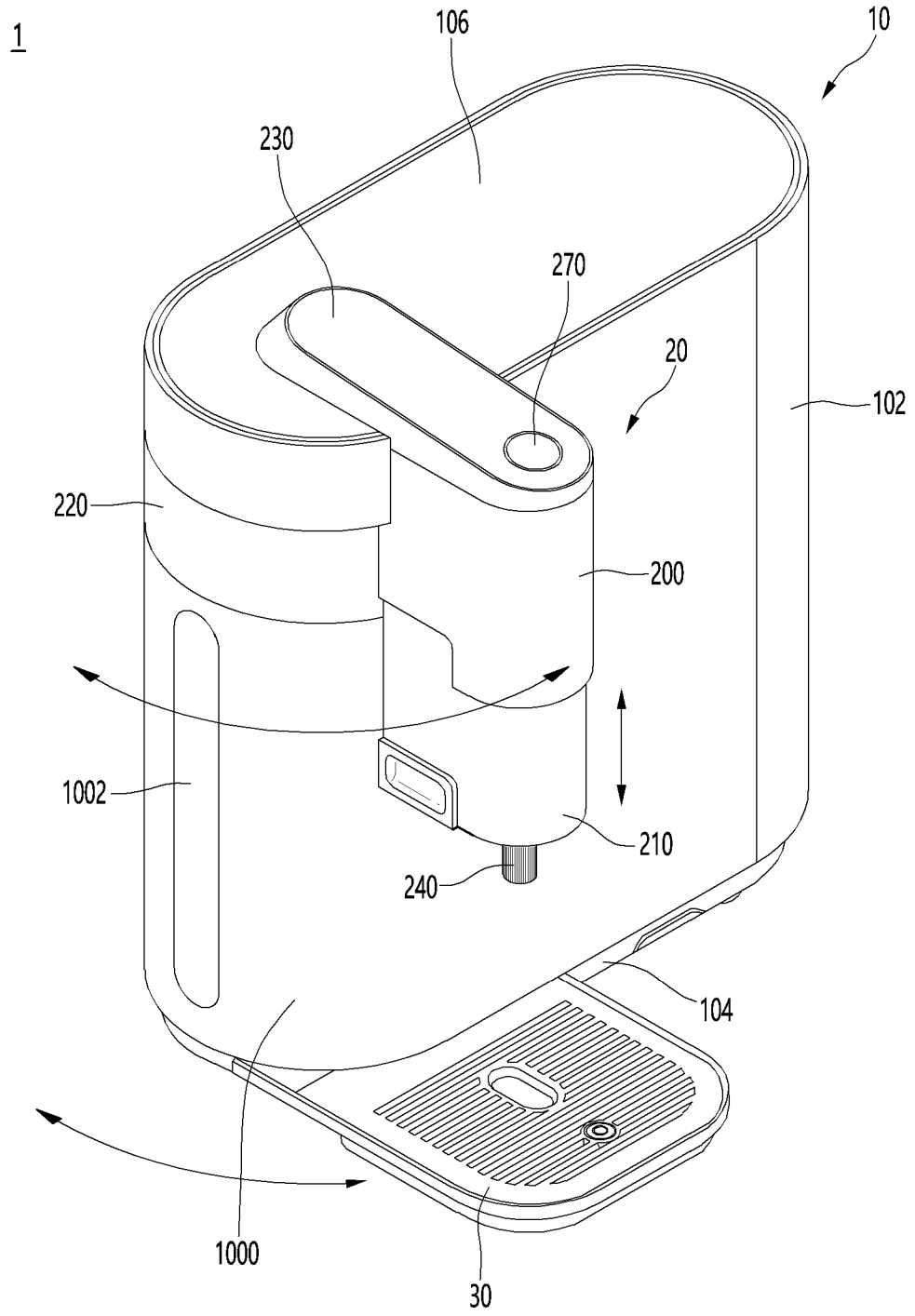
FIG. 2 is a view illustrating an example state in which the water discharge device changed example positions of a water discharge nozzle of the water discharge device.

FIG. 2 is a view illustrating an example state in which the water discharge nozzle of the water discharge device is changed in position.

As illustrated in FIG. 2, the water discharge unit 20 may be provided to be rotatable or elevatable. Thus, the water discharge nozzle 240 may rotate or be elevated. In some examples, the tray 30 may rotate according to the rotation to the water discharge nozzle 240.

First, the rotation of the water discharge unit 20 will be described. The water discharge unit 20 may rotate as the rotator 220 rotates. That is, as the rotator 220 rotates, the water discharge covers 200 and 210, the water discharge top cover 230, and the water discharge nozzle 240 may rotate.

Here, the water discharge unit 20 may rotate along the front cover 100 and have a rotational radius of approximately 180 degrees. In some examples, as the input portion 270 is provided on the water discharge top cover 230, the input portion 270 may rotate together with the water discharge unit 20 to secure user's convenience.

The tray 30 is rotatably coupled to the base cover 104 to rotate in correspondence with the water discharge unit 20. Thus, the tray 30 also has a rotational radius of approximately 180 degrees.

In some examples, the elevation of the water discharge unit 20 will be described. The water discharge elevation cover includes a first elevation cover 200 and a second elevation cover 210 movably coupled to the first elevation cover 200. The first elevation cover 200 may be fixed to the rotator 220.

In some examples, the water discharge top cover 230 may be coupled to an upper end of the first elevation cover 200. The second elevation cover 210 is disposed inside the first elevation cover 200 to move along the first elevation cover 200. In some examples, the water discharge nozzle 240 may be installed on the second elevation cover 210 to move together with the second elevation cover 210.

The water discharge unit 20 may rotate and be elevated independently with respect to each other. That is, the rotation and elevation of the water discharge unit 20 may be performed simultaneously or independently. For example, the rotation of the water discharge unit 20 may be performed according to the installation location, and the elevation of the water discharge unit 20 may be performed according to the height of the water intake container.

In some examples, the water discharge unit 20 may be provided as a structure that is rotatable or elevatable. That is, the water discharge unit 20 may be provided as a structure that is lifted without being rotated. Thus, the rotator 220 may be disposed to be fixed to the case 10.

Hereinafter, internal constituents of the water discharge device 1 will be described in detail.

Figure 4:
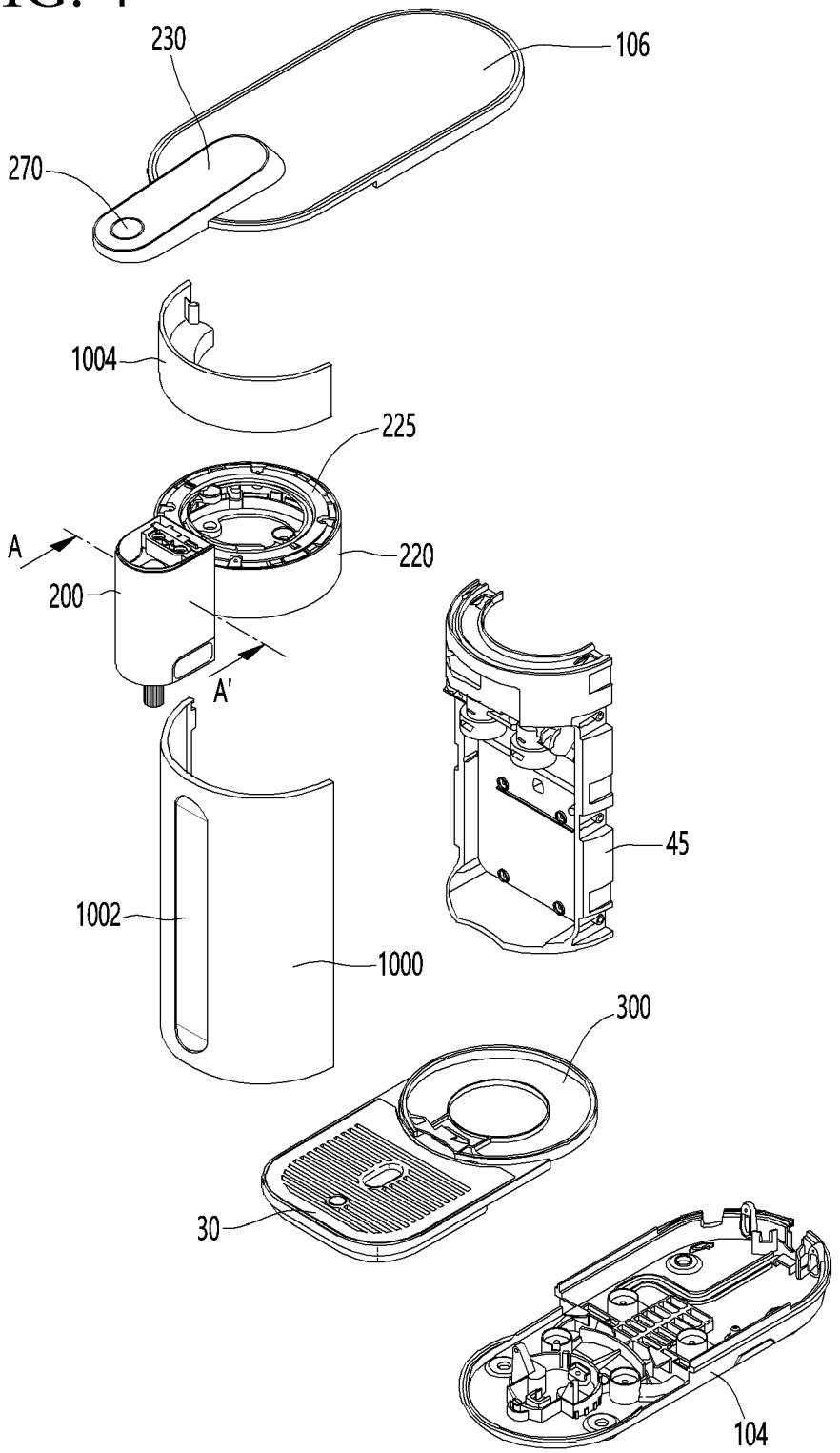
FIG. 4 is a view illustrating some of components FIG. 3 coupled to each other for convenience of description.

FIG. 3 is an exploded view of the water discharge device. FIG. 4 is a view illustrating an example state in which some of components FIG. 3 are coupled to each other for convenience of description.

The water discharge device 1 illustrated in FIGS. 3 and 4 includes constituents that are capable of supplying purified water, cold water, and hot water. However, this is also merely an example, and the constituents of the water discharge device 1 are not limited thereto and may be omitted or added. In some examples, for convenience of description, the pipe through which water flows is illustrated as being omitted.

As illustrated in FIGS. 3 and 4, the water discharge device 1 includes a filter 40 disposed inside the case 10, a cooling tank 50, a compressor 60, a condenser 70, and induction heating assembly 80. In some examples, a filter bracket 45 on which the filter 40 is mounted is provided inside the case 10.

The filter bracket 45 may be seated on the base cover 104 so as to be adjacent to the front cover 100. In some examples, the rotator 220 may be seated on the filter bracket 45. That is, the filter bracket 45 may be provided at a height corresponding to the lower front cover 1000.

Each of upper and lower ends of the filter bracket 45 are provided in a semicircle shape having a curvature corresponding to the front cover 100. In some examples, the filter bracket 45 defines a space that is recessed backward to accommodate the filter 40.

In detail, the filter 40 is disposed in a space defined between the filter bracket 45 and the front cover 100. The filters 40 may purify supplied raw water (tap water) and be constituted by combination of filters having various functions. That is, the filter 40 may be provided in various numbers and various shapes.

In some implementations, the filter bracket 45 may include various valves connected to respective pipes. For example, a pipe through which water introduced into the filter 40 flows and a pipe through which water purified in the filter 40 may be connected to each other.

Here, the water purified in the filter 40 may be supplied to the cooling tank 50 and the induction heating assembly 80 or the water discharge nozzle 240. That is, the water purified in the filter 40 may be supplied in the form of cold water, hot water, and purified water.

The compressor 60 and the condenser 70 provide a refrigeration cycle together with an evaporator 55 disposed inside the cooling tank 50. That is, the compressor 60 and the condenser 70 may be understood as constituents for supply of cold water.

The compressor 60 and the condenser 70 may be seated on the base cover 104. In detail, the compressor 60 and the condenser 70 may be disposed behind the filter bracket 45. In some examples, a cooling fan 65 is disposed between the compressor 60 and the condenser 70. The cooling fan 65 may be understood as a constituent for cooling the compressor 60 and the condenser 70.

In some examples, an inverter-type compressor capable of adjusting cooling capacity by varying a frequency may be used as the compressor 60. Thus, the purified water may be efficiently cooled to reduce power consumption.

In some examples, the condenser 70 may be disposed at a position corresponding to a discharge hole defined in the rear cover 102. The condenser 70 may be provided by bending a flat tube-type refrigerant tube several times so as to improve heat exchange efficiency while using space efficiently.

In some examples, the condenser 70 may be disposed to be accommodated in the condenser bracket 75. The condenser bracket 75 provides a space having a shape corresponding to the whole shape of the condenser 70 to accommodate the condenser 70. In some examples, the condenser bracket 75 is provided so that portions facing the cooling fan 65 and a discharge hole of the rear cover 102 are opened to effectively cool the condenser 70.

A tank mounting portion 53 in which the cooling tank 50 is accommodated is disposed on an upper portion of the condensation bracket 75. The tank mounting portion 53 is understood as a constituent for fixing the cooling tank 50. For example, the tank mounting portion 53 is provided so that a lower end of the cooling tank 50 is inserted therein.

The cooling tank 50 cools purified water to make cold water, and cooling water that is heat-exchanged with the introduced purified water is filled into the cooling tank 150. In some examples, an evaporator 55 for cooling the cooling water may be accommodated in the cooling tank 50. In some examples, the purified water may pass through the cooling tank 150 so as to be cooled.

The induction heating assembly 80 may be configured to heat the purified water, i.e., heat the purified water in an induction heating manner. The induction heating assembly 80 may immediately and quickly heat water when dispensing of hot water is manipulated and also may control an output of magnetic fields to heat the purified water at a desired temperature and thereby to provide the hot water to the user. Thus, hot water having a desired temperature may be dispensed according to the user's manipulation.

In some examples, the induction heating assembly 80 is seated and installed on the support plate 85. The support plate 85 is provided to extend from the filter bracket 45 to the cooling tank 50. In some examples, the support plate 85 is provided above the compressor 60.

In some examples, the water discharge device 1 includes a controller 140. The controller 140 may control the above-described constituents to control driving of the water discharge device 1. In detail, the controller 140 may be configured to control the compressor 60, the cooling fan 65, various valves, sensors, and the induction heating assembly 80. The controller 140 may be provided as a module by combination of PCBs that are divided into a plurality of parts for each function.

In some examples, the controller 140 may function to heat purified water together with the induction heating assembly 80. Thus, the controller 140 is disposed at one side of the induction heating assembly 80. In detail, the induction heating assembly 80 may be coupled to the induction heating assembly 80 in one module state and be seated on the support plate 85.

In some examples, the water discharge device 1 is provided with a rotational structure of the water discharge unit 20. That is, a structure in which the rotator 220 and the tray 30 are rotatably provided may be provided.

As illustrated in FIGS. 3 and 4, rotation mounting portions 225 and 227 coupled to the rotator 220 are provided. The rotation mounting portions 225 and 227 are provided in a ring shape having an outer diameter corresponding to the rotator 220.

For example, guide rails may be disposed on the rotation mounting portions 225 and 227, and the rotator 220 may slidably move along the guide rails. In addition, the rotation mounting portions 225 and 227 may be provided as a pair of plates in which ball bearings or rollers are disposed.

The rotation mounting portion includes an upper rotation mounting portion 225 coupled to an upper end of the rotator 220 and a lower rotation mounting portion 227 coupled to a lower end of the rotator 220. The lower rotation mounting portion 227 may be fixed to the upper end of the filter bracket 45. In addition, the upper rotation mounting portion 225 may be fixed to the lower end of the upper front cover 1104.

In addition, as illustrated in FIGS. 3 and 4, a tray mounting portion 300 coupled to the tray 30 is provided. The tray mounting portion 300 is fixed to the base cover 104 and is provided in a ring shape having an outer diameter corresponding to the front end of the base cover 104.

A tray hook 310 coupled to the tray mounting portion 300 may be provided on the tray 30. That is, the tray 30 is detachably hooked to the tray mounting portion 300. Therefore, the user may easily remove and clean the tray 30.

Figure 5A:
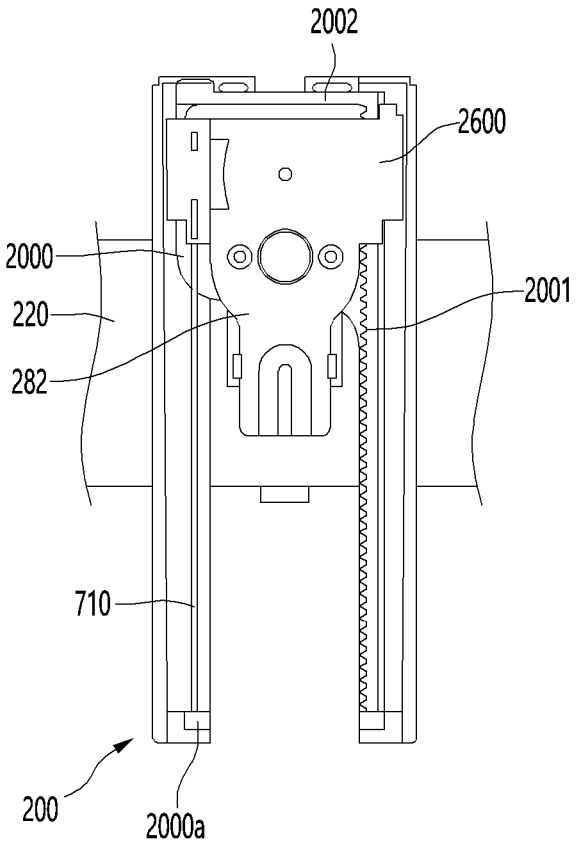
FIGS. 5A and 5B are views illustrating example states of an example second elevation cover that ascends and descends when viewed in a direction A-A' of FIG. 3.
Figure 5B:
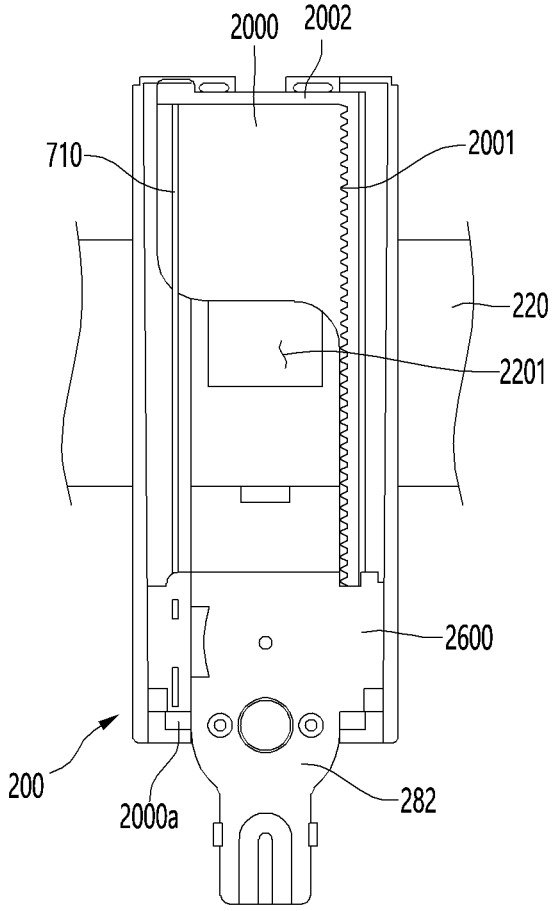
Figure 6A:
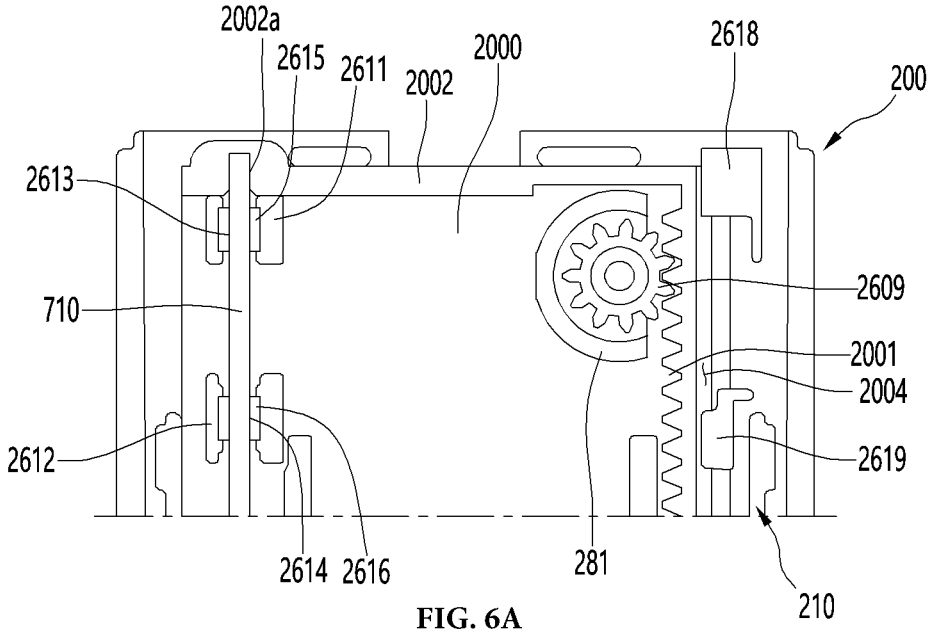
FIGS. 6A and 6B are views illustrating example states of the second elevation cover that ascends and descends when viewed from a rear side.
Figure 6B:
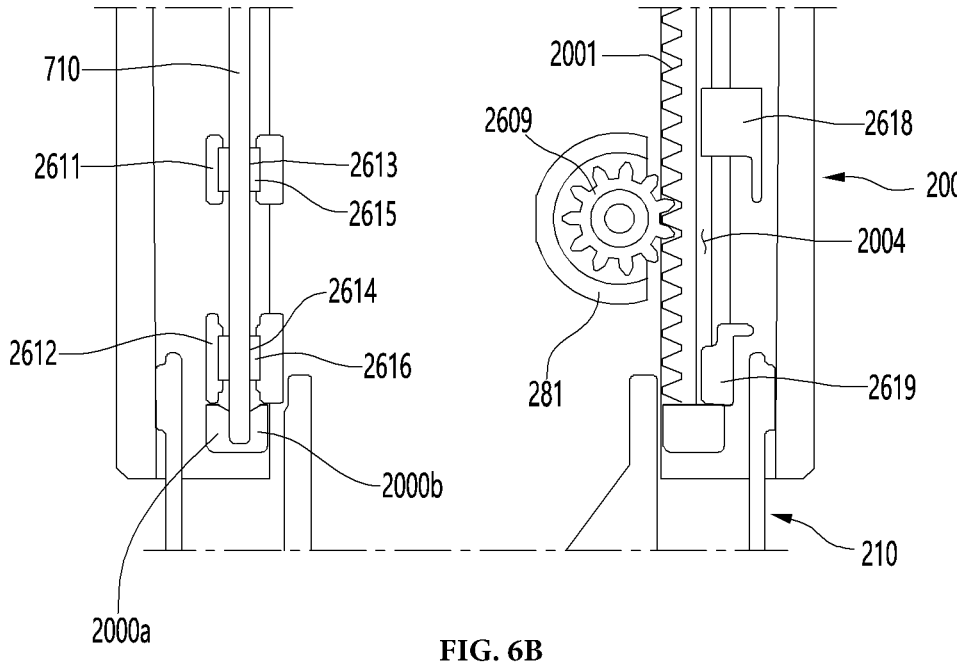
Figure 7A:
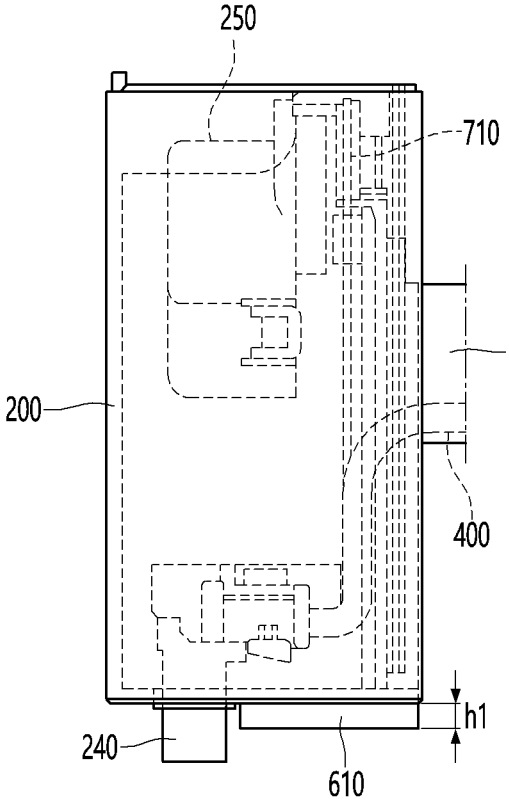
FIGS. 7A and 7B are views illustrating example states of the second elevation cover that ascends and descends when viewed from a side surface.
Figure 7B:
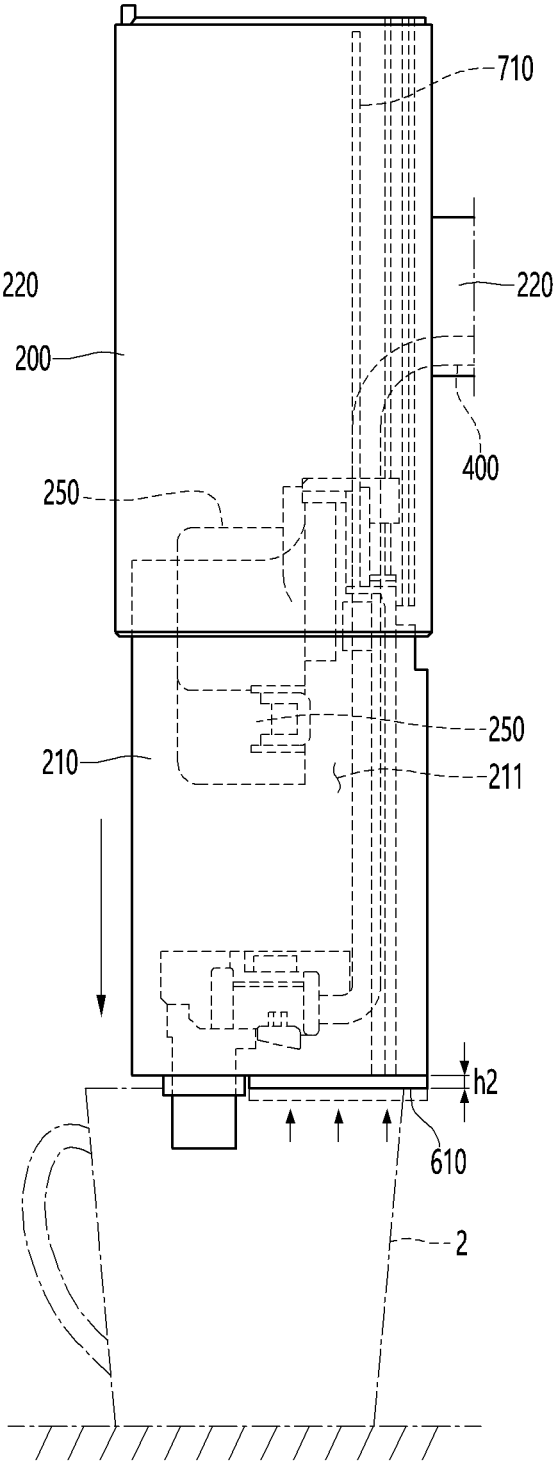

FIGS. 5A and 5B are views illustrating an example state in which the second elevation cover ascends and descends when viewed in a direction A-A' In some examples, FIGS. 6A and 6B are views illustrating an example state in which the second elevation cover ascends and descends when viewed from a rear side. In some examples, FIGS. 7A and 7B are views illustrating an example state in which the second elevation cover ascends and descends when viewed from a side surface. In some examples, FIG. 8 is a view illustrating examples of an elevation motor and a gear module when viewed from the side surface.

For example, a direction viewed from the rear side in FIGS. 6A and 6B may be a direction opposite to the direction viewed from the direction A-A' in FIG. 4.

Figure 8:
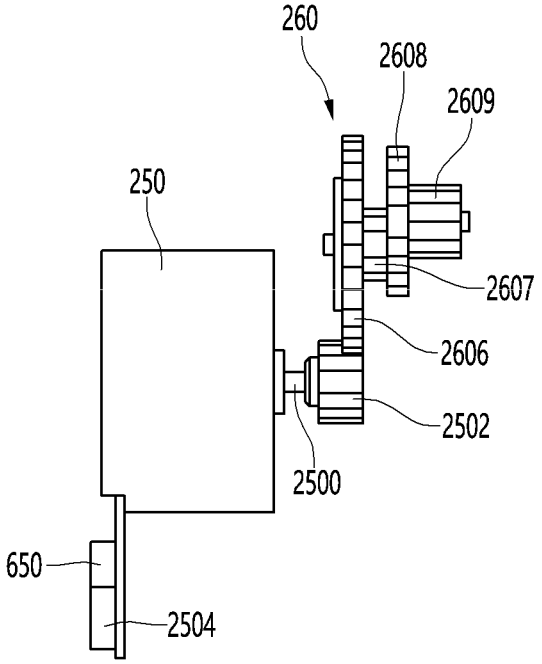
FIG. 8 is a view illustrating examples of an elevation motor and a gear module when viewed from the side surface.

Referring to FIGS. 5A and 5B and 8, the water discharge unit 20 includes the water discharge elevation covers 200 and 210 and the rotator 220. In some examples, the water discharge elevation covers include the first elevation cover 200 and the second elevation cover 210.

As described above, the first elevation cover 200 is fixed, and the second elevation cover 210 is movable. However, this is merely an example, and the first and second elevation covers 200 and 210 may be provided in various forms that are capable of be movable relative to each other. For example, the first and second elevation covers 200 and 210 may be provided to be movable.

As described above, the rotator 220 is provided in a cylindrical shape. In some examples, a front side of the rotator 220 may define an outer appearance of the front surface of the water discharge device 1 together with the front cover 100.

The first elevation cover 200 is coupled to the outside of the rotator 220. At least a portion of the rear side of the first elevation cover 200 is opened and has a hollow shape. In some examples, the first elevation cover 200 is provided with a first plate 2000. The first plate 2000 may be integrated with the first elevation cover 200 or may be provided as a separate member.

The first plate 2000 may define the rear surface of the first elevation cover 200.

The first plate 2000 may at least partially cover the opened rear side of the first elevation cover 200.

Referring to FIGS. 5A and 5B, a through-hole 2201 is defined in the rotator 220. The through-hole 2201 corresponds to a hole through which the water discharge pipe extending to the water discharge nozzle 240 passes.

In some examples, the elevation gear 2001 extending vertically may be disposed on the first plate 2000.

The elevation gear 2001 is disposed on a surface facing a central side of the first elevation cover 200. In some examples, the elevation gear 2001 may extend vertically from an upper end to a lower end of the first plate 2000.

The elevation gear 2001 may correspond to a straight rack. That is, the elevation gear 2001 has gear teeth extending in the vertical direction.

The second elevation cover 210 is disposed inside the first elevation cover 200. In some examples, the second elevation cover 210 moves downward from the inside of the first elevation cover 200.

The second elevation cover 210 is provided in a shape corresponding to the first elevation cover 200.

A structure in which the water discharge nozzle 240 is installed may be provided at a lower end of the second elevation cover 210. For example, an opening through which the water discharge nozzle 240 is fitted may be provided at a lower portion of the second elevation cover 210.

A grip portion 2013 that is held by the user may be provided on each of both lower ends of the second elevation cover 210. The grip portion 2013 corresponds to an auxiliary constituent by which the second elevation cover 210 manually moves by the user. In some examples, the grip portion 2013 may be provided in various shapes so that the second elevation cover 210 conveniently moves by the user.

The water discharge unit 20 further includes an elevation motor 250 and a gear module 260 interlocked with the elevation motor 250.

The elevation motor 250 includes a wire and a connector 2504, which are connected to an external power source or a main PCB, a motor shaft 2500 rotating by the power supply, and a motor gear 2502 connected to the motor shaft 2500. The motor gear 2502 corresponds to a spur gear in which gear teeth are cut side by side with the motor shaft 2500.

The elevation motor 250 may be coupled to the second elevation cover 210. In detail, the elevation motor 250 may be coupled to the second elevation cover 210 so that the motor shaft 2500 extends in the horizontal direction, and the motor gear 2502 is disposed at the rear side.

The elevation motor 250 may be provided as a BLDC motor having a brake function.

The gear module 260 may be provided as a plurality of gears rotating by the elevation motor 250. In some examples, a gear bracket 2600 for allowing the plurality of gears to be rotatably fixed is provided.

Referring to FIG. 8, the gear module 260 includes a first gear 2606, a second gear 2607, a third gear 2608, and a fourth gear 2609, which are mounted on the gear bracket 2600. Here, the number and shape of the gear may be merely an example.

The first gear 2606 corresponds to a gear engaged with the motor gear 2402. In some examples, the second gear 2605 is coaxially connected to the first gear 2606. Here, the first gear 2606 and the second gear 2605 may be provided as one gear.

A size (diameter) of the first gear 2606 may be larger than that (diameter) of the second gear 2605.

The third gear 2608 corresponds to a gear engaged with the second gear 2607. In some examples, the fourth gear 2609 is coaxially connected to the third gear 2608. Here, the third gear 2608 and the fourth gear 2609 may be provided as one gear.

A size (diameter) of the third gear 2608 may be larger than that (diameter) of the fourth gear 2609.

Then, the fourth gear 2609 is engaged with the elevation gear 2001. Here, the elevation gear 2001 corresponds to a fixed constituent that is disposed on the first elevation cover 200. In some examples, the fourth gear 2609 corresponds to a constituent mounted on the gear bracket 2600 and coupled to the second elevation cover 210. Thus, as the fourth gear 2609 rotates, the second elevation cover 210 may move.

As described above, since the gear module 260 is constituted by a plurality of gears, the gear module 260 may function as a reduction gear.

Referring to FIGS. 7A and 7B to 8, when the second elevation cover 210 is elevated, the water discharge nozzle 240 coupled to the lower portion of the second elevation cover 210 is elevated together. In some examples, the water discharge nozzle 240 is connected to a water discharge pipe 400.

The water discharge pipe 400 may extend from the inside of the case 10 to the inside of the water discharge unit 20 and then be connected to the water discharge nozzle 240.

In some examples, the water discharge pipe 400 may be elevated together with the second elevation cover 210 when the second elevation cover 210 is elevated in the state in which the water discharge pipe 400 is disposed inside the second elevation cover 210.

In some examples, the water discharge pipe 400 may rotate together with the water discharge unit 20 when the water discharge unit 20 rotates in the state in which the water discharge pipe 400 is disposed inside the second elevation cover 210.

The water discharge pipe 400 accommodated inside the second elevation cover 210 may be disposed in an empty space provided below the elevation motor 250 and the gear module 260.

Referring to the drawings, the gear module 260 is disposed behind the elevation motor 250. That is, the elevation motor 250 is disposed in front of the gear module 260. Here, the rear side may be a direction that is close to the case 10.

Then, a space 211 may be defined under the gear module 260, and the water discharge pipe 400 may be inserted into the second elevation cover 210 through the space 211 and connected to the water discharge nozzle 240 through the space 211.

Here, the gear module 260 includes a plurality of gears.

In some examples, a motor gear 2502 is connected to the motor shaft 2500 of the elevation motor 250.

The gear module 260 includes a first gear 2606, a second gear 2607, a third gear 2608, and a fourth gear 2609.

All of the first gear 2606, the second gear 2607, the third gear 2608, and the fourth gear 2609 may be disposed behind the elevation motor 250.

In some examples, all of the first gear 2606, the second gear 2607, the third gear 2608, and the fourth gear 2609 may be disposed above the motor shaft 2500 of the elevation motor 250.

In some examples, the rotation shafts of the first gear 2606 and the second gear 2605 are disposed above the rotation shaft of the motor gear 2502 and may be disposed eccentrically to one side.

For instance, the one side may be a direction in which the elevation gear 2001 is disposed.

Further, the rotation shafts of the third gear 2608 and the fourth gear 2609 may be disposed above the rotation shafts of the first gear 2606 and the second gear 2605 and be disposed eccentrically to one side. Thus, the elevation gear 2001 engaged with the fourth gear 2609 may be disposed at one side that is maximally spaced apart from the central portion Thus, a space 211 in which the water discharge pipe 400 is accommodated may be widely secured below the gear module 260.

If the motor gear 2502 connected to the motor shaft 2500 of the elevation motor 250 is directly engaged with the elevation gear 2001 to rotate, or only one gear is connected between the motor gear 2502 and the elevation gear 2001, the gear may be larger to cause a limitation that it is difficult to secure the space for disposing the gear.

In some examples, when the plurality of gears are connected between the motor gear 2502 and the elevation gear 2001, each of the gears may decrease in size, and the gears may be installed only at one side so that the space is easily secured inside the second elevation cover. In some examples, there is an advantage that the space in which the water discharge pipe 400 is accommodated is secured.

In some examples, when the plurality of gears are connected between the motor gear 2502 and the elevation gear 2001, there is also an advantage of using a gear ratio to finely adjust an elevation speed. That is, it is easy to control the elevation speed of the second elevation cover 210.

In some implementations, while the water discharge unit 20 is provided to enable the elevation and rotation operation with respect to the case 10, the user may more easily grip the water discharge unit 20, and the first and second elevation covers 200 and 210 defining the outer appearance of the water discharge unit 20 may be convex forward.

Thus, a space may be provided therein, and the elevation motor 250, the gear module 260, and the water discharge pipe 400 may be accommodated in the space.

For instance, the elevation motor 250 may be disposed at the central portion that is convex forward.

One side of the water discharge pipe 400 is accommodated inside the second elevation cover 210 and is connected to the water discharge nozzle 240.

In some implementations, the water discharge pipe 400 is disposed into the rotator 220 through a water discharge groove 2014 defined behind the second elevation cover 210 and a water discharge groove 2004 defined behind the first elevation cover 200. The water discharge pipe 400 may be disposed inside the case 10.

The water discharge pipe 400 may be made of an elastic material such as rubber or silicone so as to be bent or spread when the second elevation cover 210 is elevated.

In this case, when the second elevation cover 210 and the water discharge nozzle 240 are elevated, the water discharge pipe 400 may be bent or spread into the space 211 of the second elevation cover 210 to correspond to the elevation operation of the second elevation cover 210. Furthermore, the cold water, the purified water, and the hot water may be supplied to the water discharge nozzle 240 regardless of the height of the second elevation cover 210 and the water discharge nozzle 240.

In some examples, when the second elevation cover 210 and the water discharge nozzle 240 are elevated, the water discharge pipe 400 may be bent or spread vertically in the space 211 of the second elevation cover 210 to flexibly respond to the elevation operation of the second elevation cover 210.

Referring to FIGS. 7A and 7B, a touch bar 610 to be described later is exposed on the bottom surface of the second elevation cover 210.

The touch bar 610 is exposed by a first height h1 before contacting the water intake container 2.

Thereafter, when the second elevation cover 210 descends, the touch bar 610 contacts the water intake container 2 to ascend. In some examples, a sensing sensor disposed above the touch bar 610 may sense the ascending of the touch bar 610 and sense the height of the water intake container.

As described above, when the touch bar 610 contacts the water intake container 2, while the touch bar 610 ascends, the touch bar 610 may be exposed to the bottom surface of the second elevation cover 210 by a second height h2 less than the first height h1 before contacting the water intake container 2.

Referring again to FIGS. 5A and 5B to 6, a guide bar 710 may be mounted to the first elevation cover 200.

The guide bar 710 may be mounted on the rear surface of the first elevation cover 200.

In some examples, the rear surface of the first elevation cover 200 is coupled to the rotator 220.

In some examples, an elevation gear 2001 having a rack shape may be disposed at a rear side adjacent to the rotator 220 inside the first elevation cover 200.

The elevation gear 2001 may be integrated with the rear surface of the first elevation cover 200.

Since the guide bar 710 is provided, when the second elevation cover 210 moves vertically, a phenomenon in which a clearance occurs in the horizontal direction may be improved.

The guide bar 710 may be made of a metal material.

In some examples, the guide bar 710 may be provided in a cylindrical shape.

In some examples, the guide bar 710 may be disposed at a side opposite to the elevation gear 2001 disposed on the first elevation cover 200.

In some examples, the guide bar 710 may be disposed on both sides.

Thus, when the second elevation cover 210 is elevated, while both sides of the second elevation cover 210 are supported to contact the uppermost and lowermost ends, the elevation operation of the second elevation cover 210 may be maintained in a straight line.

That is, since the guide bar 710 is provided as described above, when the second elevation cover 210 is disposed at the uppermost and lowermost ends, the clearance may be constantly maintained, and the elevation operation of the second elevation cover 210 may be maintained in the straight line without being shaken.

The upper end of the guide bar 710 may be fixed to the upper end of the other side of the first plate 2000 (left side in FIGS. 6A and 6B). In some examples, the lower end of the guide bar 710 may be fixed to the lower end of the other side of the rear of the first elevation cover 200 (left side in FIGS. 6A and 6B).

For this, a second plate 2002 extending in a horizontal direction may be disposed on the upper end of the first plate 2000.

The second plate 2002 may define a guide bar mounting groove 2002*a* that is concave upward in the bottom surface. The upper end of the guide bar 710 may be inserted into and fixed to the guide bar mounting groove 2002*a*.

When the fourth gear 2609 ascends, the second plate 2002 may also function as a stopper that prevents the fourth gear 2609 from further ascending at a top dead point of the fourth gear 2609.

A guide bar mounting protrusion 2000*a* that is convex forward is disposed forward on a lower end of the front surface of the first elevation cover 200.

The guide bar mounting protrusion 2000*a* defines a guide bar mounting groove 2000*b* that is concave downward from the top surface thereof. In some examples, the lower end of the guide bar 710 may be fixed by being inserted into the guide bar mounting groove 2000*b*.

In some examples, a guide bar passing hole through which the guide bar 710 passes may be defined in the second elevation cover 210. Thus, when the guide bar 710 is inserted into the guide bar passing hole, and the second elevation cover 210 is elevated, the elevation operation of the second elevation cover 210 may be guided in a straight line by the guide bar 710.

For example, auxiliary protrusions 2611 and 2612 protruding backward may be disposed on the gear bracket 2600 through which the guide bar 710 passes.

The guide bars passing holes 2613 and 2614 through which the guide bars 710 pass may be defined in the auxiliary protrusions 2611 and 2612, respectively.

The auxiliary protrusions 2611 and 2612 may be defined by being spaced apart from each other in the vertical direction. That is, the auxiliary protrusions 2611 and 2612 may be constituted by an upper auxiliary protrusion 2611 and a lower auxiliary protrusion 2612. In some examples, the guide bars passing holes 2613 and 2614 may be defined in the auxiliary protrusions 2611 and 2612, respectively.

Thus, the clearance between the first elevation cover 200 and the second elevation cover 210 may be reliably secured.

In some examples, anti-friction members 2615 and 2616 that reduce friction between the guide bar 710 and the auxiliary protrusions 2611 and 2612 may be inserted into the guide bar passing holes 2613 and 2614, respectively.

Therefore, the elevation operation of the second elevation cover 210 may be performed more smoothly.

When the guide bar 710 is provided as described above, the second elevation cover 210 may have one side supported to contact the guide bar 710 and the other side supported to contact the elevation gear 2001.

Accordingly, while both sides of the second elevation cover 210 are supported to contact the first elevation cover 200, the clearance between the first elevation cover 200 and the second elevation cover 210 may be more reliably removed, and also, while the second elevation cover 210 is linearly elevated in the vertical direction, the elevation operation of the second elevation cover 210 may be stably performed.

In some examples, the first plate 2000 may define a shake prevention groove 2004 extending in the vertical direction in an outer surface of one side on which the elevation gear 2001 is disposed.

In some examples, the gear bracket 2600 may be disposed to be spaced apart from upper and lower sides of shake prevention protrusions 2618 and 2619 protruding from the rear side to the inside so as to be inserted into the shake prevention groove 2004. The shake prevention protrusions 2618 and 2819 may be disposed on opposite sides of the auxiliary protrusions 2611 and 2612, respectively.

When the shake prevention protrusions 2618 and 2919 are inserted into the shake prevention groove 2005*f* as described above, while the gear bracket 2600 and the second elevation cover 210 are elevated, the gear bracket 2600 and the second elevation cover 210 may be prevented from being shaken forward and backward.

For reference, reference numerals '281' in FIGS. 5A and 5B and 6 refer to a 'gear cover' covering the gear module 260, and reference numeral '282' refers to a 'motor cover' covering the elevation motor 250.

Figure 9:
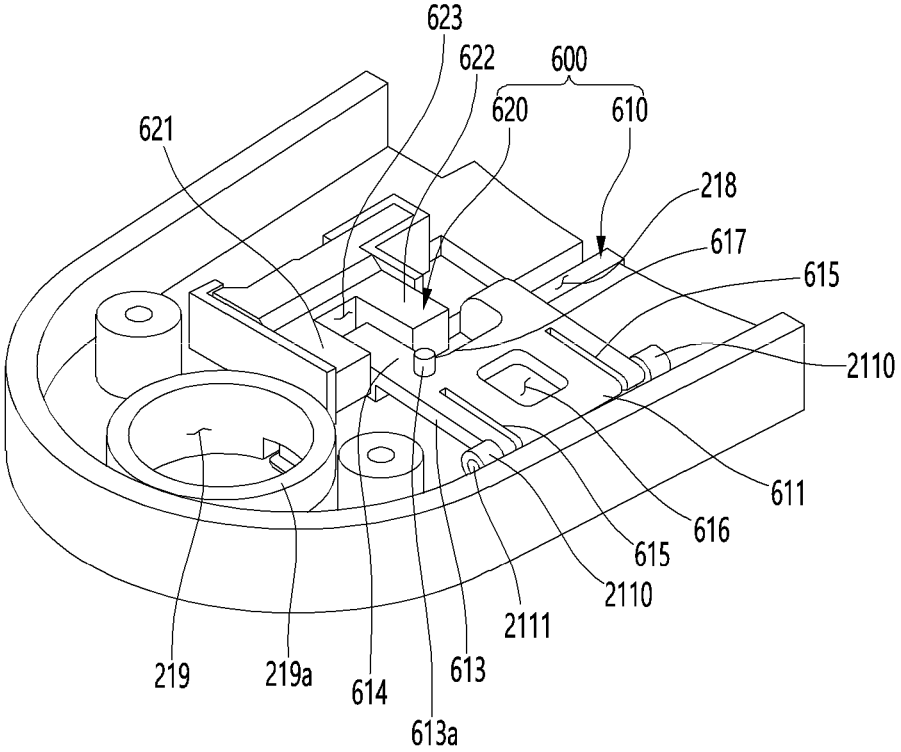
FIG. 9 is a partial perspective view illustrating the second elevation cover.
Figure 10:
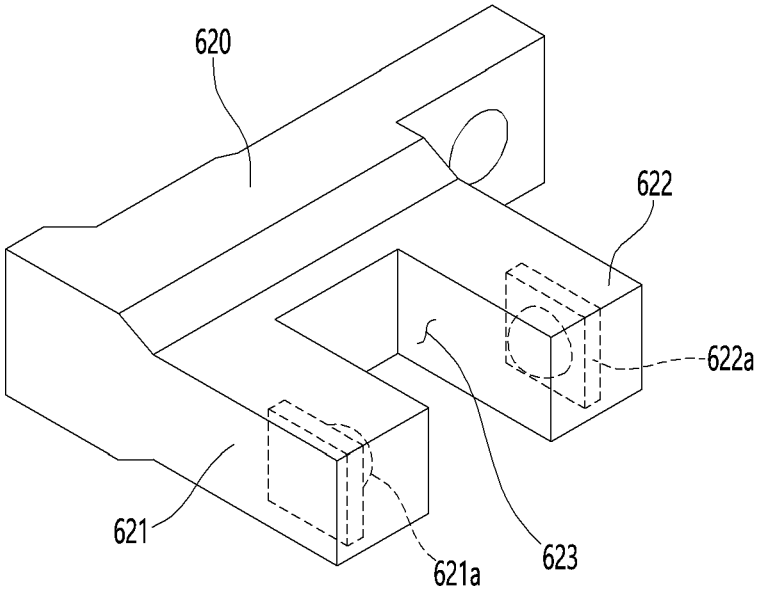
FIG. 10 is a perspective view illustrating an example sensing sensor.
Figure 11:
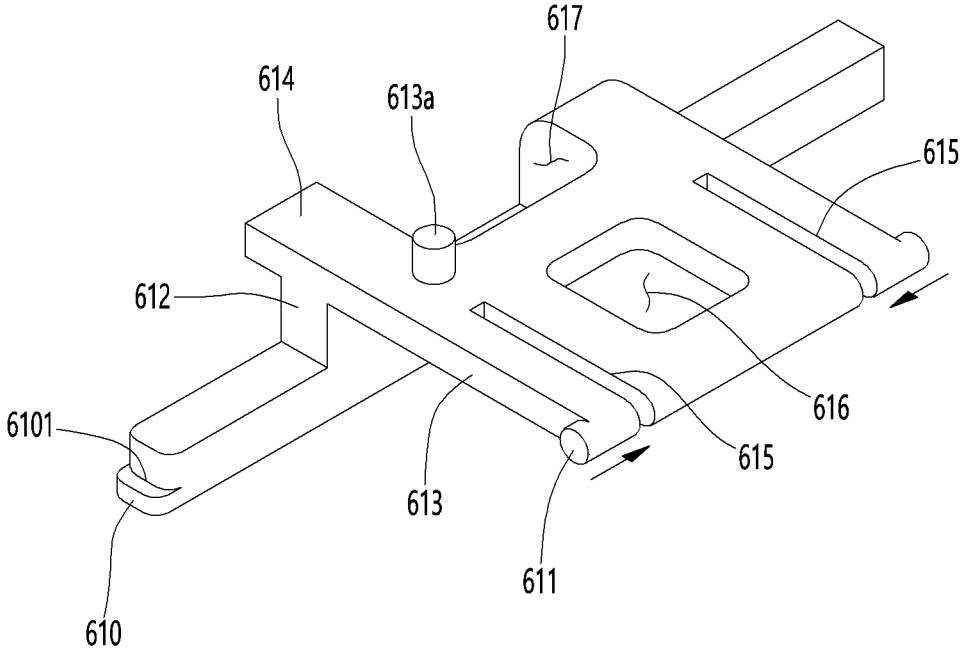
FIG. 11 is a perspective view illustrating an example touch bar.
Figure 12:
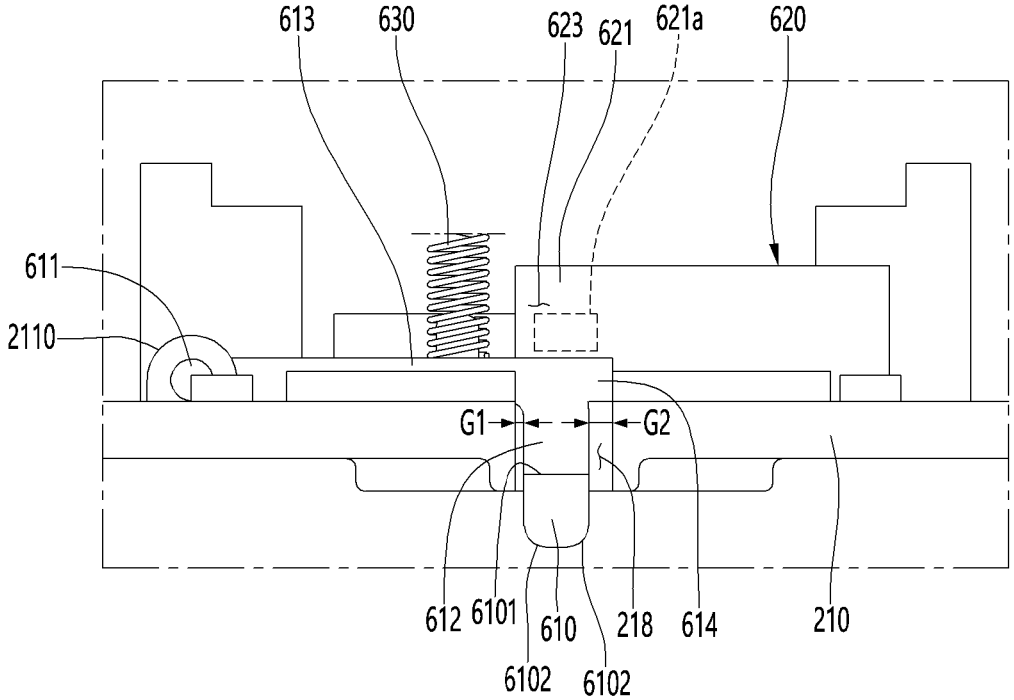
FIG. 12 is a longitudinal cross-sectional view illustrating the second elevation cover in a state in which the touch bar descends.
Figure 13:
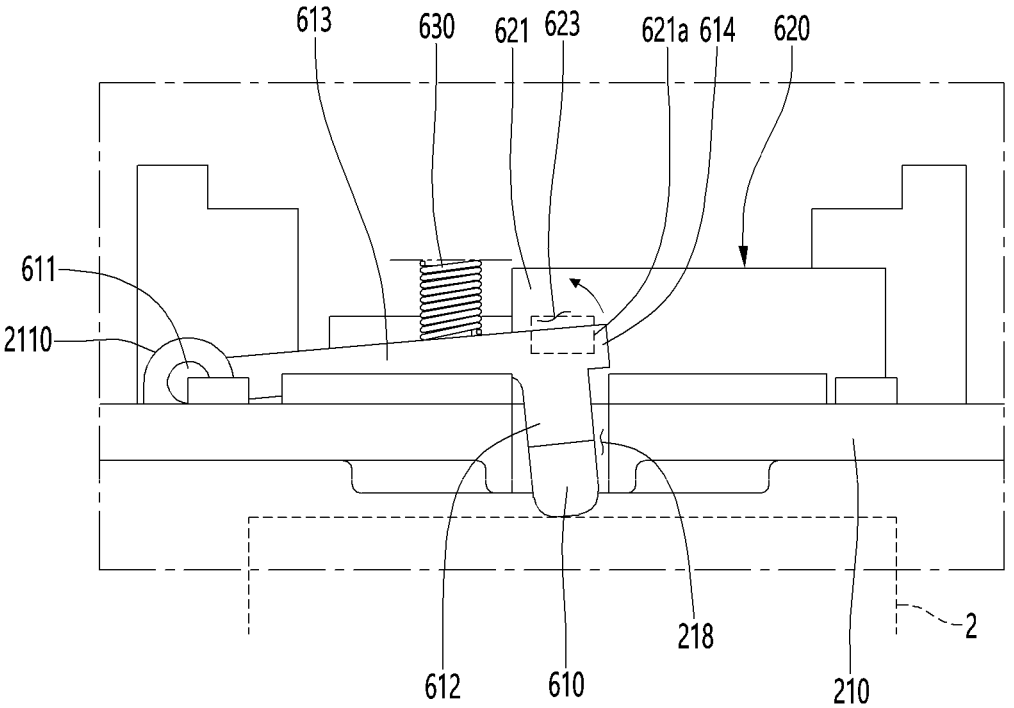
FIG. 13 is a longitudinal cross-sectional view illustrating the second elevation cover in a state in which the touch bar ascends.

FIG. 9 is a partial perspective view illustrating the second elevation cover. FIG. 10 is a perspective view illustrating the sensing sensor. FIG. 11 is a perspective view illustrating an example of a touch bar. FIG. 12 is a longitudinal cross-sectional view illustrating the second elevation cover in a state in which the touch bar descends. FIG. 13 is a longitudinal cross-sectional view of the second elevation cover in a state in which the touch bar ascends.

The water discharge device has a function of allowing the second elevation cover 210 to be automatically elevated.

In detail, when the user puts the water intake container under the water discharge nozzle 240 to input a water discharge command, before the water discharge proceeds, the second elevation cover 210 descends to sense a height of the water intake container.

Then, in a state in which the second elevation cover 210 descends adjacent to the height of the water intake container, water discharge proceeds.

For this, the second elevation cover 210 is provided with a sensor 600.

For example, the sensor 600 may sense the water intake container in a contact manner.

As another example, the sensor 600 may sense the height of the intake container in a non-contact manner.

In some implementations, the sensor 600 may sense the height of the water intake container in the contact manner.

The sensor 600 may include the touch bar 610 that is exposed to the bottom surface of the second elevation cover 210 and disposed on a virtual line L1 connecting a center of the case 10 of the water discharge nozzle 240.

The touch bar 610 may be disposed in a front-rear direction in a state in which the water discharge unit 20 is disposed at the center.

In some examples, the touch bar 610 may be provided to be movable in the vertical direction.

The touch bar 610 may be installed to appear and disappear downward from the second elevation cover 210 while being elevated vertically from the inside of the second elevation cover 210.

For example, the touch bar 610 may be disposed on the virtual line L1 connecting the center of the water discharge nozzle 240 to the center of the rotator 220 and be exposed in a straight shape on the bottom surface of the second elevation cover 210.

In some examples, the touch bar 610 may be disposed in the entire section between the water discharge nozzle 240 and the lower front cover 1000.

A slit hole 218 through which at least a portion of the touch bar 610 is opened and exposed may be defined in the bottom surface of the second elevation cover 210.

In some examples, the second elevation cover 210 may have a through-hole 219 through which the water discharge nozzle 240 passes.

For example, one side of the slit hole 218 may be defined to communicate with the through-hole 219. In some examples, the other side of the slit hole 218 may be defined up to the other end of the lower surface of the second elevation cover 210. The other end of the slit hole 218 has an opened shape.

In some examples, the touch bar 610 exposed through the slit hole 218 may have a length greater than that of the slit hole 218.

As described above, since the touch bar 610 has the long length, the heights of all the water intake containers placed between the water discharge nozzle 240 and the plane portion 1002 of the front cover 100 may be sensed.

In some examples, the second elevation cover 210 may include a sidewall 219*a* extending upward along a circumference of the through-hole 219. The periphery of the water discharge nozzle 240 may be surrounded by the sidewall 219*a*, and thus, the water discharge nozzle 240 may be fixed more reliably.

The touch bar 610 may be mounted to be elevatable or rotatable on the second elevation cover 210.

For example, the touch bar 610 may be elevated while rotating with respect to the second elevation cover 210.

For this, the touch bar 610 may include a rotation shaft 611 rotatably coupled to the second elevation cover 210.

In some examples, a pair of rotation shaft coupling portions 2110 disposed spaced apart in the front-rear direction and protruding upward may be disposed on the bottom surface of the second elevation cover 210 so that the rotation shaft 611 is rotatably fitted. In some examples, a rotation shaft coupling hole 2111 into which the rotation shaft 611 is inserted may be defined in the rotation shaft coupling portion 2110.

Thus, the rotation shaft 611 may be inserted into the rotation shaft coupling hole 2111 to rotate.

Here, the rotation shaft 611 may be disposed parallel to the touch bar 610.

In addition, the touch bar 610 may be connected to the rotation shaft 611 by connection portions 612 and 613.

The connection portions 612 and 613 may include a vertical connection portion 612 extending upward from an upper side of the touch bar 610 and a horizontal connection portion 613 extending horizontally to connect an upper side of the vertical connection portion to the rotation shaft 611.

The horizontal connection portion 613 may have a plurality of slits 615 that are concavely cut in a direction crossing the rotation shaft 611 so that the rotation shaft 611 is more easily inserted into the rotation shaft coupling hole 2111. A distance between both ends of the rotation shaft 611 may be narrowed and then expanded by the slit 615 and thus be more easily inserted into the rotation shaft coupling hole 2111.

In some examples, the touch bar 610 may have a flat end facing the plane portion 1002.

In some examples, the touch bar 610 may have a stepped portion 6101 at an end thereof facing the water discharge nozzle 240.

The stepped portion 6101 may be provided in a stair shape. Thus, a surface area of the water discharge nozzle 240, which faces the end of the touch bar 610, may be minimized by the stepped portion 6101, and when the touch bar 610 rotates and is elevated, the end of the touch bar 610 may be prevented from interfering due to the contact with the water discharge nozzle 240.

In some examples, the length of the touch bar 610 exposed to the outside may be as long as possible to sense the height of all the water intake containers disposed between the water discharge nozzle 240 and the plane portion 1002.

Referring to FIG. 12, the touch bar 610 descends by its own weight. In this state, the horizontal connection portion 613 and the vertical connection portion 612 may have a bent shape (e.g., '¬' shape).

In some examples, while the second elevation cover 210 descends, when the touch bar 610 contacts an upper end of the water intake container 2, the touch bar 610 ascends. In detail, as illustrated in FIG. 13, the touch bar 610 rotates around the rotation shaft 611 to ascend by a predetermined height.

In some examples, it is necessary to reduce a weight of the touch bar 610 so that the touch bar 610 more sensitively react when contacting the upper end of the water intake container 2. Thus, at least one lightweight hole 616 for the weight reduction may be defined in the horizontal connection portion 613 of the touch bar 610.

As described above, when the touch bar 610 ascends while the touch bar 610 contacts the upper end of the water intake container 2, it is necessary to stop the descending of the second elevation cover 210 through the sensing of the contact with the upper end.

For this, the sensing sensor 620 including a transmitter 621 and a receiver 622 may be mounted on an upper side of the touch bar 610.

The sensing sensor 620 may provide a spaced space 623 between the transmitter 621 and the receiver 622.

In some examples, the transmitter 621 and the receiver 622 are respectively disposed to face each other to exchange signals therebetween.

For example, the transmitter 621 and the receiver 622 may exchange optical signals.

As another example, the transmitter 621 and the receiver 622 may exchange infrared (IR) signals.

As another example, the sensing sensor 620 may be provided as a photo interrupt sensor. Here, the sensing sensor 620 may sense the touch bar 610 in a contact manner or a non-contact manner.

In some implementations, the sensing sensor 620 may have at least a portion made of a material capable of transmitting infrared rays. For example, the cover of the sensing sensor 620 may be made of a PC material having high transmittance. In some cases, a blocking portion 614 disposed between the transmitter 621 and the receiver 622 may be made of an opaque ABS material having low light transmittance.

In some examples, the touch bar 610 is accommodated in a space 623 defined between the transmitter 621 and the receiver 622 while ascending together when the touch bar 610 ascends to provide the blocking portion 614 that prevents a signal of the transmitter 621 from being received to the receiver 622.

When the touch bar 610 descends, the blocking portion 614 may be escaped from the spaced space 623 defined between transmitter 621 and the receiver 622 while descending. Here, the signal of the transmitter 621 may be received to the receiver 622.

In some examples, an evacuation portion 617 that is concave to accommodate one of the transmitter 621 and the receiver 622 may be disposed on the connection portions 612 and 613 of the touch bar 610.

The evacuation portion 617 may be provided to be concave in the direction of the rotation shaft 611. The evacuation portion 617 may be provided to be concave downward from an upper side.

When the signal transmitted from the transmitter 621 is received to the receiver 622, the controller 140 may determine that the touch bar 610 does not ascend, and as a result, the touch bar 610 does not contact the upper end of the water intake container 2. That is, in the state in which the second elevation cover 210 descends, the controller 140 may determine that the second elevation cover 210 does not yet approach the water intake container, and thus, the descending operation of the second elevation cover 210 may be maintained.

In some cases, if the signal transmitted from the transmitter 621 is not received to the receiver 622, the controller 140 may determine that the blocking portion ascends while the touch bar 610 ascends so as to be accommodated in the spaced space 623 defined between the transmitter 621 and the receiver 622. That is, it may be determined that the touch bar 610 contacts the upper end of the water intake container 2. Furthermore, in the state in which the second elevation cover 210 descends, the controller 140 may determine that the second elevation cover 210 contacts the water intake container to stop the descending of the second elevation cover 210.

Here, when the second elevation cover 210 contacts the water intake container, the water intake container is in a state in which force is applied to the water intake container. Thus, to prevent the second elevation cover 210 and the water intake container from being damaged and deformed and protect the water discharge nozzle 240, before water is discharged, the second elevation cover 210 may ascend by a predetermined height.

Then, the water discharge proceeds.

As described above, when the second elevation cover 210 ascends, the touch bar 610 may be spaced apart from the upper end of the water intake container and then descend to its original position (state of FIG. 12) by the touch bar 610.

Here, the touch bar 610 may receive force that is pushed downward by an elastic member 630 provided on the upper side thereof.

A lower end of the elastic member 630 contacts and supports the upper end of the touch bar 610.

For example, the elastic member 630 is provided as a coil spring, and a lower end of the elastic member 630 is inserted into an insertion protrusion 613*a* provided above the horizontal connection portion 613 so that the elastic member 630 may be supported to contact the insertion protrusion 613*a*.

In some implementations, the upper side of the elastic member 630 may be supported to contact one side of an upper frame 216. For example, the upper frame 216 includes a bottom surface, and an insertion protrusion inserted into the upper side of the elastic member 630 may extend downward.

The touch bar 610 may receive the force that is pushed downward by the elastic member 630, and in the state in which the touch bar 610 does not contact the water intake container, a state in which the touch bar 610 is exposed to the lower side of the second elevation cover 210 may be maintained.

In some examples, when the touch bar 610 contacts the water intake container, the elastic member 630 is compressed, and the touch bar 610 ascends.

When the touch bar 610 is separated from the water intake container, the elastic member 630 is restored by its own elasticity, and thus, the touch bar 610 descends to return to the original position.

As described above, in the state in which the water discharge unit 20 is disposed at the center (the state of FIG. 1), the touch bar 610 may extend in the front-rear direction, and when the rotation shaft 611 of the touch bar 610 is disposed parallel to the touch bar 610, the water intake container 2*a* and 2*b* having various sizes may be sensed.

In some implementations, tension of the elastic member 630 may be adjusted, or a distance between the sensor 620 and the touch bar 610 may be adjusted to control a reaction speed of the sensor 620.

For example, when the tension of the elastic member 630 is reduced, the touch bar 610 may reacts sensitively when contacting the water intake container, and as a result, the reaction speed of the sensing sensor 620 may increase.

In some cases, when the tension of the elastic member 630 increases, the touch bar 610 may react insensitively when contacting the water intake container, and as a result, the reaction speed of the sensing sensor 620 may decrease.

As another example, if the distance between the sensing sensor 620 and the touch bar 610 is narrowed, even if the touch bar 610 slightly ascends when contacting the water intake container, the sensing sensor 620 may sense the touch bar 610, and as a result, the reaction speed of the sensing sensor 620 may increase.

In some cases, if the distance between the sensing sensor 620 and the touch bar 610 increases, the sensing sensor 620 may sense the touch bar 610 only when the touch bar 610 ascends to a predetermined distance or more while contacting the intake container, and as a result, the reaction speed of the sensing sensor 620 may decrease.

In addition, regardless of the size of each of the water intake containers 2*a* and 2*b*, in all sections, the water intake containers 2*a* and 2*b* may be sensed with the same sensitivity.

In some examples, the touch bar 610 may have a cross-section that is convex downward so as to linearly contact the upper end of the water intake container disposed under the water discharge nozzle 240.

As described above, when the touch bar 610 and the water intake container linearly contact each other, the water intake container may be more sensitively sensed.

In some examples, the touch bar 610 rotates when contacting the upper end of the water intake container disposed under the water discharge nozzle 240. In some examples, a curved portion may be provided on a lower end of the touch bar 610 so that the lower end of the touch bar 610 is smoothly maintained in the state of contacting the upper end of the water intake container 2 when the touch bar 610 rotates.

In some examples, when the touch bar 610 rotates, the touch bar 610 may be maintained in the state of linearly contacting the water intake container.

In some examples, a distance G2 between the other end (right side in FIG. 12) of the slit hole 218 and the touch bar 610 may be greater than a distance G1 between one end (left side in FIG. 12) of the slit hole 218 and the touch bars 610.

Here, the rotation shaft 611 is in a state of being disposed at one side of the slit hole 218.

In this state, when the lower end of the touch bar 610 contacts the upper end of the water intake container, the touch bar 610 rotates with respect to the rotation shaft 611.

In some examples, as illustrated in FIG. 33, the touch bar 610 is adjacent to the other end of the slit hole 218 (the right side in FIG. 32).

Thus, when the touch bar 610 rotates, the distance G2 between the other end (right side in FIG. 12) of the slit hole 218 and the touch bar 610 may be greater than the distance G1 between one end (left side in FIG. 12) of the slit hole 218 and the touch bars 610 so that the touch bar 610 does not contact the other end (right in FIG. 12) of the slit hole 218.

In some examples, the blocking portion 614 of the touch bar 610 may be maintained a state in which the upper end thereof is accommodated in the spaced space 623 between the transmitter 621 and the receiver 622.

That is, in the state in which the touch bar 610 does not detect the water intake container, i.e., in the state of descending, the upper end of the blocking portion 614 may be accommodated in the spaced space 623 defined between the transmitter 621 and the receiver 622.

As described above, even in the state of descending, when the upper end of the blocking portion 614 is maintained in the state of being accommodated in the spaced space 623 between the transmitter 621 and the receiver 622, the sensing sensor 620 may sense the touch bar 610 even if the touch bar 610 slightly ascends when the touch bar 610 contacts the water intake container, and thus, the controller may more quickly control the operation of the elevation motor.

In some implementations, the touch bar 610 may extend in the front-rear direction (left-right direction in FIG. 14), and thus, all the water intake container having a relatively small inlet and the water intake container having a relatively large inlet may be sensed.

Figure 14:
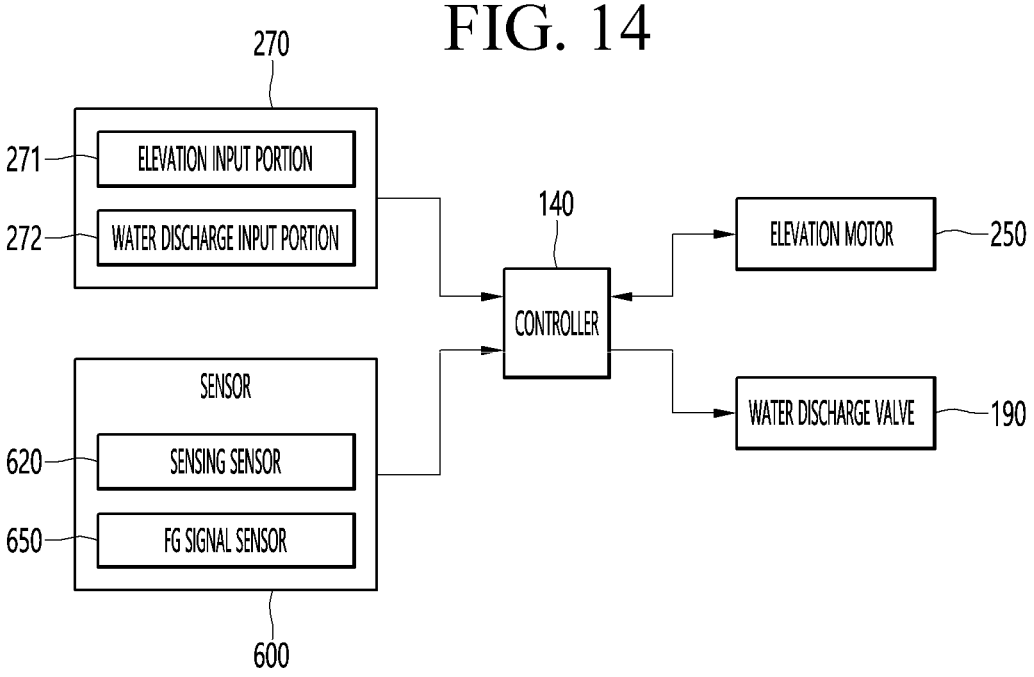
FIG. 14 is a block diagram illustrating an example configuration of a water discharge device.

In some implementations, when the rotation shaft 611 of the touch bar 610 is disposed in the front-rear direction (left-right direction as illustrated in FIG. 14) like the touch bar 610 to sense a height when the water intake container having the relatively small inlet ascends and a height when the water intake container with the relatively large inlet ascends, the heights may be the same. That is, since the touch bar 610 ascends at the same height at any position, the water intake containers may be sensed with the same sensitivity in all sections regardless of the sizes of the water intake containers.

In some implementations, the touch bar 610 may have the same minimum ascending height, i.e., the sensing height so as to sense the water intake containers so that the water intake containers are sensed in all the sections without no sensing area of the water intake containers and regardless of the sizes and positions of the water intake containers.

Figure 15:
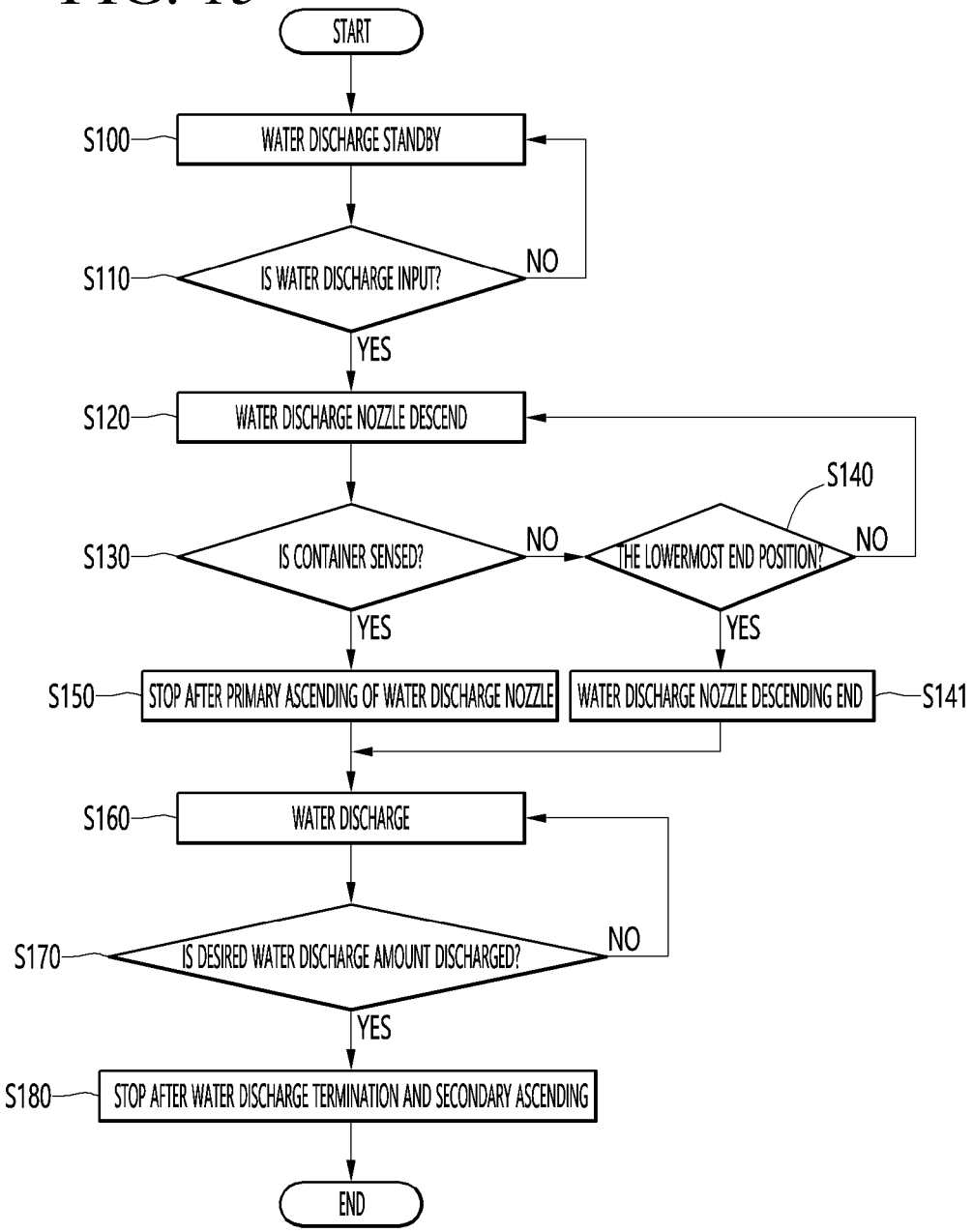
FIG. 15 is a view illustrating an example control flow of the water discharge device of FIG. 14.

FIG. 14 is a block diagram illustrating an example configuration of a water discharge device. In some examples, FIG. 15 is a view illustrating an example control flow of the water discharge device of FIG. 14, and FIG. 16 is a view for description of FIG. 15.

Figure 16:
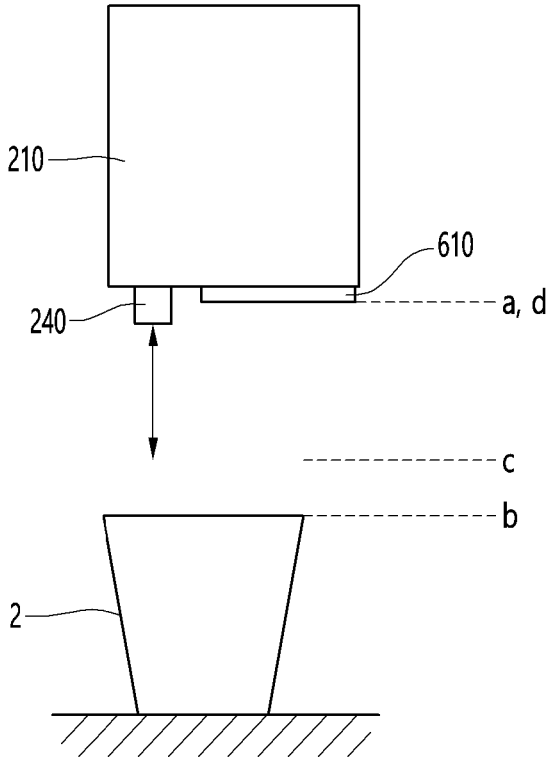
FIG. 16 is a view illustrating an example water discharge device and an example container.

Referring to FIGS. 14 and 16, a method for controlling a water discharge device will be described.

First, the water discharge device 1 is provided in a water discharge standby state (S100).

Here, the water discharge standby state may be understood as a state in which power is connected to the water discharge device 1. In some examples, a second elevation cover 210 and a water discharge nozzle 240 are in an elevated state. Here, a lower end of a touch bar 610 is disposed at a height of 'a' in FIG. 16.

In the standby state as described above, it is determined whether a water discharge command is generated from a user (S110).

Then, when the water discharge command is sensed, the second elevation cover 210 and the water discharge nozzle 240 descend (S120).

In detail, a controller 140 drives an elevation motor 250. Thus, a motor shaft 2500 rotates, and power is transmitted to a gear module 260. In addition, a fourth gear 2609 may rotate to descend along an elevation gear 2001.

After operation S120, the sensing sensor 620 senses whether the touch bar 610 and the water intake container contact each other (S130).

In detail, while the second elevation cover 210 and the water discharge nozzle 240 continue to descend, and then, at least a portion of the touch bar 610 contacts an upper end of the water intake container disposed below the water discharge nozzle 240, the sensing sensor 620 may sense the upper end of the water intake container. Here, a lower end of the touch bar 610 is disposed at a height of 'b' in FIG. 16.

Then, while the touch bar 610 rotates, the lower end of the touch bar 610 ascends by a predetermined height from the height of 'b' in FIG. 16.

That is, the second elevation cover 210 and the water discharge nozzle 240 descend until the touch bar 610 and the sensing sensor 620 sense the upper end of the container.

If the upper end of the container is not sensed by the sensor 600, the second elevation cover 210 and the water discharge nozzle 240 descend up to the lowermost end (S140).

A controller 140 may control a rotation speed of the elevation motor 250 so that the rotation speed decreases in stages when the second elevation cover 210 approaches a bottom dead point.

For example, if the second elevation cover 210 and the water discharge nozzle 240 continue to descend, the second elevation cover 210 and the water discharge nozzle 240 may reach the bottom dead point, and a large load may be temporarily applied to the elevation motor 250.

In some examples, when such a load is input, the controller 140 may determine that the descending up to the lowermost end is completed to stop driving of the elevation motor 250, thereby stopping the descending of the second elevation cover 210 and the water discharge nozzle 240 (S141).

As another example, if the second elevation cover 210 and the water discharge nozzle 240 continue to descend, the second elevation cover 210 and the water discharge nozzle 240 may reach the bottom dead point, and the controller may determine that the second elevation cover 210 and the water discharge nozzle 240 reach the bottom dead point through an FG signal sensed in a signal sensing portion 650.

In detail, when moving from a standby position to the bottom dead point, the FG signal may be stored, and the controller 140 may compare the FG signal sensed in the signal sensing portion 650 with the stored FG signal to determine whether the second elevation cover 210 and the water discharge nozzle 240 reach the bottom dead point.

In some examples, when it is determined that the second elevation cover 210 and the water discharge nozzle 240 reach the bottom dead point in this manner, the controller 140 may stop the driving of the elevation motor 250 to stop the descending of the second elevation cover 210 and the water discharge nozzle 240 (S141).

For example, as described above, while the second elevation cover 210 and the water discharge nozzle 240 reach the lowermost end, or the touch bar 610 contacts the upper end of the water intake container, when the sensing sensor 620 senses the water intake container, water discharge proceeds immediately (S160).

As another example, when the second elevation cover 210 and the water discharge nozzle 240 descend, while the touch bar 610 contacts the upper end of the water intake container, when the water intake container is sensed by the sensing sensor 620, the water discharge may not immediately proceed, and the second elevation cover 210 and the water discharge nozzle 240 may ascend by a set height.

Here, the lower end of the touch bar 610 is disposed at a height of 'c' in FIG. 16.

For example, the second elevation cover 210 and the water discharge nozzle 240 may ascend by about 15 mm.

Thereafter, the water discharge proceeds (S160).

In detail, while a water discharge valve is opened, water within a water discharge pipe 400 is discharged to the water discharge nozzle 240.

Here, the dispensed water may correspond to purified water, cold water or hot water depending on user's selection or setting.

Then, it is determined whether an amount of discharged water reach a target flow rate (S170).

For example, the water flow rate may be sensed by a flow sensor. The flow sensor may be installed on a pipe connected to a rear end of a filter 40 with respect to a flow direction of water to sense the flow rate of water flowing after passing through the filter 40.

When the water flow rate reaches the target flow rate, the water flow is terminated, and the controller 140 may drive the elevation motor 250 to allow the second elevation cover 210 and the water discharge nozzle 240 to ascend to their original positions (S180).

Here, the original positions may refer to positions of the second elevation cover 210 and the water discharge nozzle 240 in the standby state (S100).

Here, the ascending of the second elevation cover 210 and the water discharge nozzle 240 may be performed after a predetermined time after the water discharge is terminated.

For example, when the water discharge is terminated, after waiting for about 6 seconds, the second elevation cover 210 and the water discharge nozzle 240 may ascend.

In detail, when the water discharge is terminated, the controller 140 drives the elevation motor 250 in reverse after the set time. Thus, a motor shaft 2500 is rotated in reverse, and power is transmitted to the gear module 260. In some examples, when the fourth gear 2609 reversely rotates, the fourth gear 2609 may rotate to ascend along the elevation gear 2001.

Then, when the second elevation cover 210 and the water discharge nozzle 240 reach the top dead point, the operation of the elevation motor 250 is stopped, and the ascending operation of the second elevation cover 210 and the water discharge nozzle 240 is stopped.

The controller 140 may control a rotation speed of the elevation motor 250 so as to decrease in stages when the second elevation cover 210 approaches a top dead point.

For example, the second elevation cover 210 ascends, and then the second elevation cover 210 and the water discharge nozzle 240 reach the top dead point, and thus, a large load is temporarily applied to the elevation motor 250.

When such a load is input, the controller 140 may determine that the ascending is completed and stop the driving of the elevation motor 250.

As another example, if the second elevation cover 210 and the water discharge nozzle 240 continue to ascend, the second elevation cover 210 and the water discharge nozzle 240 may reach the top dead point, and the controller may determine that the second elevation cover 210 and the water discharge nozzle 240 reach the top dead point through an FG signal sensed in a signal sensing portion 650.

In detail, when moving from the bottom dead point to the top dead point, when moving from the water discharge position to the top dead point in the FG signal and operation S60, the FG signal may be stored, and the controller 140 may compare the FG signal sensed in the signal sensing portion 650 with the stored FG signal to determine whether the second elevation cover 210 and the water discharge nozzle 240 reach the top dead point.

In some examples, when the controller 140 determines that the second elevation cover 210 and the water discharge nozzle 240 reach the top dead point through the FG signal, the driving of the elevation motor 250 is stopped.

Here, the lower end of the touch bar 610 is disposed at a height of 'd' in FIG. 16.

Alternatively, when the water discharge is terminated, the second elevation cover 210 and the water discharge nozzle 240 may not immediately ascend but be maintained in the descending state until a separate instruction is applied or may be maintained in the descending state for a predetermined time and then return to an initial position (standby position).

As described above, the water discharge may be performed at a position adjacent to the water intake container by the elevation of the second elevation cover 210 and the water discharge nozzle 240. Thus, the water may be prevented from being scattered. In some examples, when water having a very high temperature is dispensed, the water may be prevented from being scattered to secure user's safety.

In some implementations, as discussed above, a structure in which the water discharge unit 20 rotates with respect to the case 10 is provided.

In some examples, a structure in which the second elevation cover 210 accommodated inside the first elevation cover 200 constituting the water discharge unit 20 is elevated is provided.

In some examples, the elevation motor 250, the gear module 260, the water discharge pipe 400 are accommodated in the second elevation cover 210, and the sensor 600 is mounted.

The sensor 600 is in a state in which at least a portion is exposed to the outside of the second elevation cover 210.

In some examples, when the user presses the water discharge button, the water discharge nozzle descends. Here, the water intake container disposed at a predetermined height or more may be sensed by the sensor 600. Then, the second elevation cover 210 may be stopped at the height of the water intake container, and the water discharge may proceed immediately, or the second elevation cover 210 may ascend by a predetermined height (for example, about 15 mm) so that the water discharge proceeds.

In some examples, although the water intake container disposed at a predetermined height or less (for example, about 120 mm) is not sensed, the water discharge may proceed in the state in which the second elevation cover 210 maximally reaches the bottom dead point to prevent the water from being splashed by a height difference in water dropping.

In some examples, in the descending state, the water discharge may be repeatedly performed after the water discharge, and when the water discharge is terminated, the second elevation cover may automatically ascend to return to the initial position.

The water discharge device as described above is provided with a water discharge button.

Thus, when the user presses the water discharge button, a predetermined amount of water is discharged.

However, in the case of the water discharge device, since a size and shape of a cup are not considered, the water discharge button has to be pressed several times to fully fill the water in the cup because an amount of water intake per one time is small.

For example, in a state in which the flow rate of water is basically set to about 50 ml, when the user presses the water discharge button, only about 50 ml of water is discharged. However, since water having only a constant flow rate is provided as described above regardless of the size and height of the cup, there is a cumbersome of pressing the water discharge button several times (about ten times) so as to receive water into a large cup having a capacity of about 500 ml.

In addition, in the case of the water discharge device as described above, there is a cumbersome that a water discharge adjustment button for controlling an amount of water to be discharged firstly operates, and a water discharge command button for commanding the water discharge secondarily operates, i.e., total two manipulations have to be performed to discharge water to an amount of water, which exceeds the desired amount.

In related art, a large number of times of button manipulations may be needed to accurately control a large amount of water to be discharged or a water discharge amount.

In addition, in the case of the water discharge device as described above, to discharge hot water and cold water, a hot water button or a cold water button for selecting a temperature of the water firstly operate, and the water discharge button for instructing the water discharge secondarily operates. Thus, the button manipulation has to be performed total two times That is, in the case of the water discharge device such as the existing refrigerator or water purifier, a desired water discharge amount may be input, but kinds of the water discharge amount may be limited due to a limitation of a key input. In some examples, there is an inconvenience in that a key has to be input several times to input a desired water discharge amount.

In some implementations, the method of controlling a water discharge device that may easily and accurately input a desired amount of discharge water without the limitation in the key input through a voice recognition function is disclosed.

Figure 17:
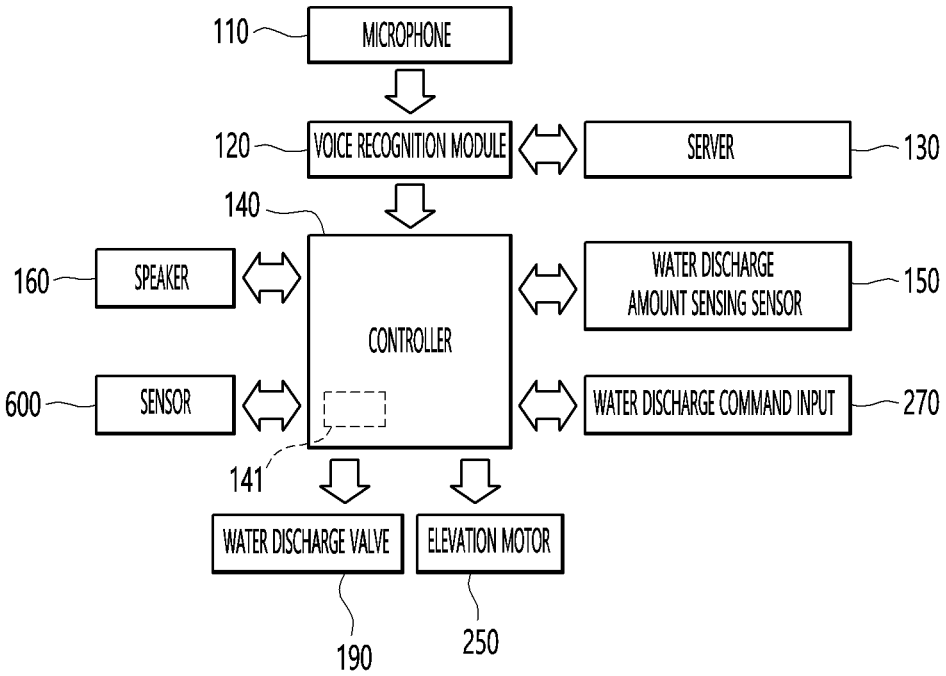
FIG. 17 is a block diagram illustrating an example configuration of a water discharge device.
Figure 18:
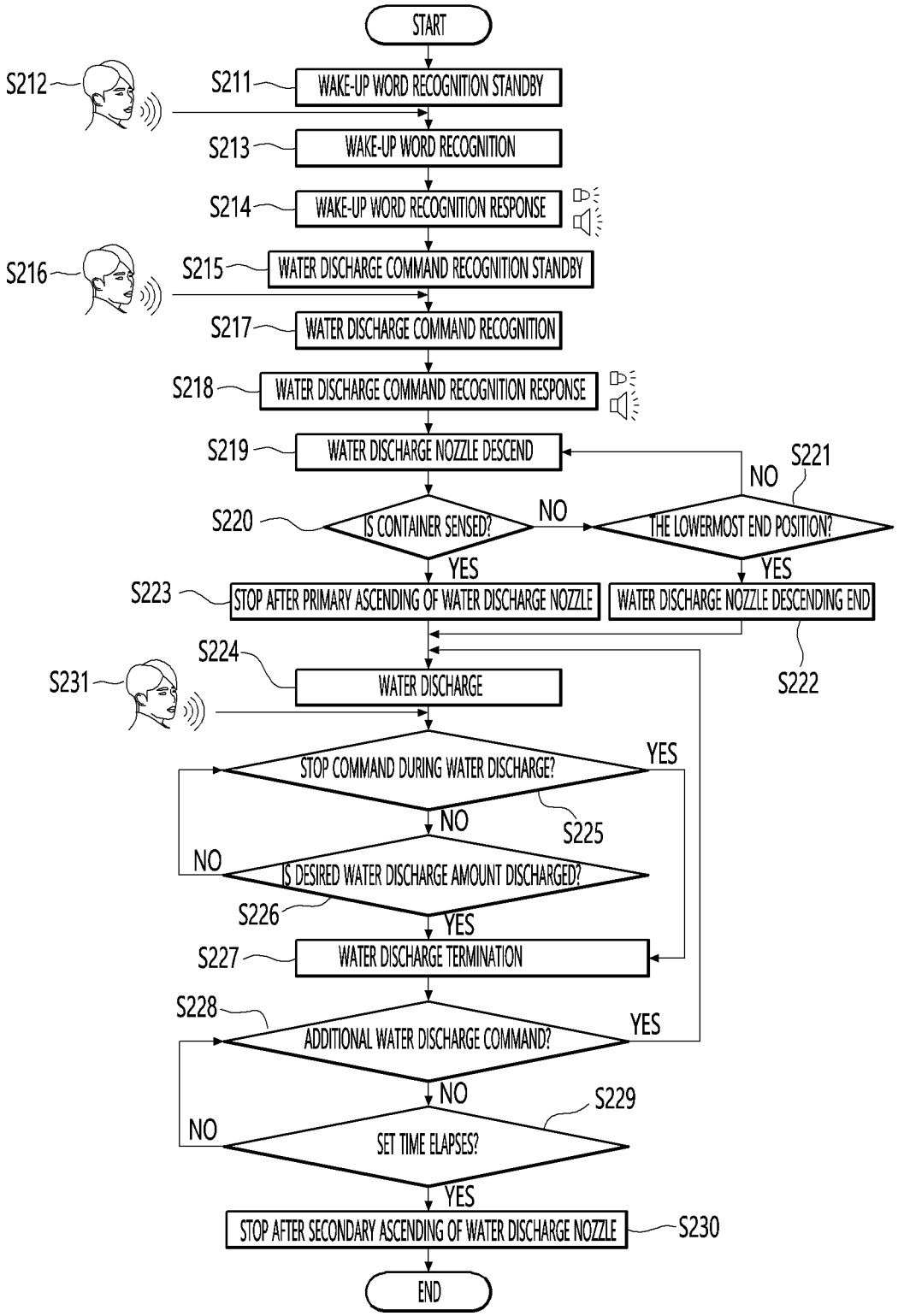
FIGS. 18 and 19 are views illustrating examples of control flows of the water discharge device of FIG. 17.
Figure 19:
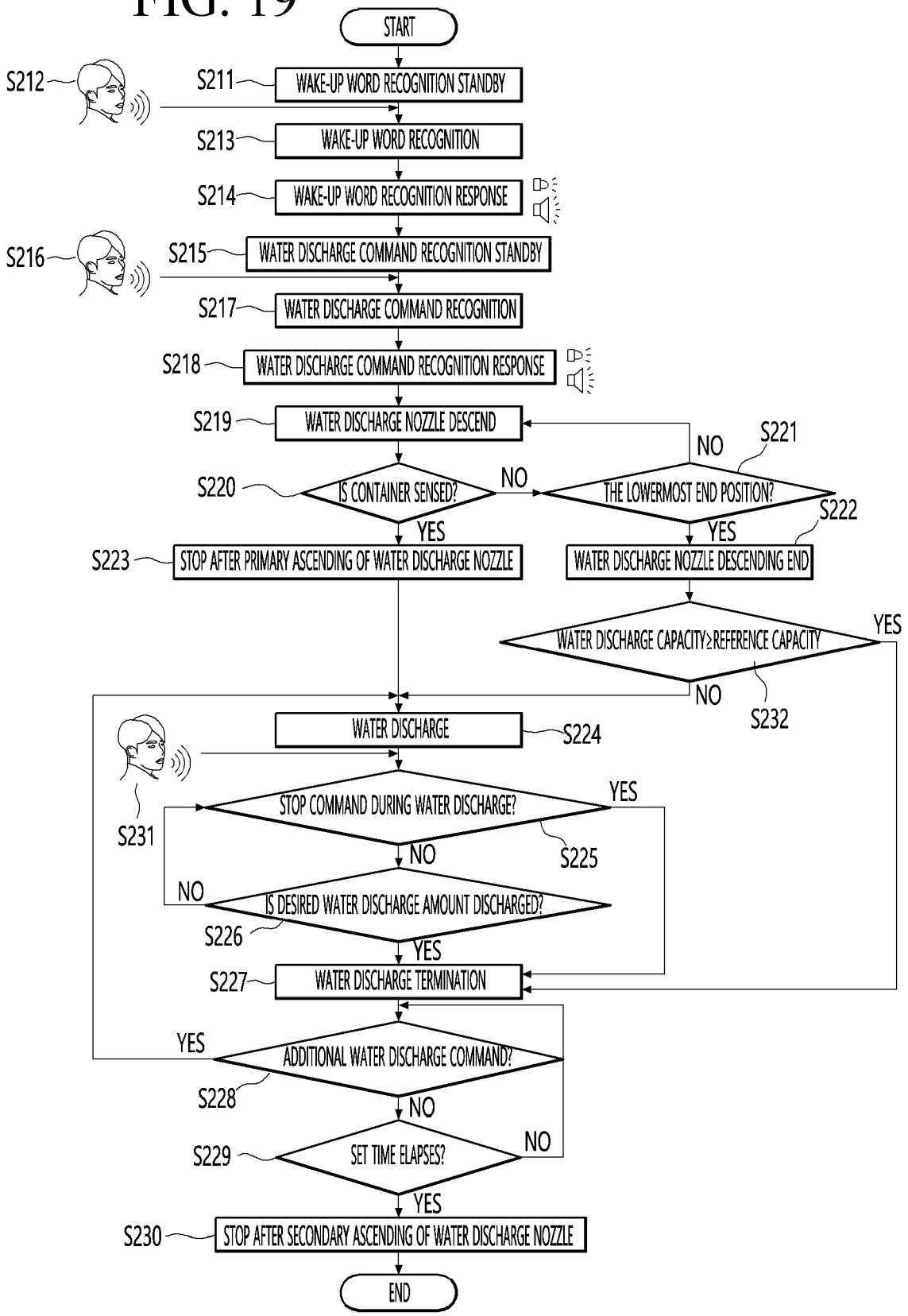

FIG. 17 is a block diagram illustrating an example configuration of a water discharge device. FIGS. 18 and 19 are views illustrating a control flow of the water discharge device of FIG. 17.

First, referring to FIGS. 17 to 18, a water discharge device may include a microphone into which voice spoken from a user is input, a voice recognition module configured to recognize voice information input into the microphone, a speaker configured to output a guide sound to the user, a water discharge valve configured to regulate a flow of a fluid flowing toward the water discharge nozzle, a flow sensor configured to sense a flow rate of the fluid flowing toward the water discharge nozzle, a sensor provided on the second elevation cover so that at least a portion of the sensor is exposed to a lower side of the second elevation cover, thereby sensing whether the second elevation cover contacts a container disposed below the second elevation cover when the second elevation cover descends, and a controller configured to control an operation of the elevation motor and an operation of the water discharge valve.

Referring to FIG. 3, the microphone 110, the voice recognition module 120, and the speaker 160 may be disposed under a top cover 106 defining a top surface of the case.

In some examples, the voice recognition module 120 may be disposed adjacent to a front cover 1000, the microphone 110 may be disposed behind the voice recognition module 120, and the speaker 160 may be disposed between the voice recognition module 120 and the microphone 110.

A method for controlling the water discharge device having the configuration as described above may perform water discharge.

In detail, the method for controlling the water discharge device is as follows.

First, in the microphone and the voice recognition module, recognition of a wake-up word stands by (S211).

In the standby state as described above, the user speaks the wake-up word by voice (S212).

Then, the wake-up word spoken by the user is input to the microphone and the voice recognition module (S213).

Here, the wake-up word input to the device may be set to "Hi, LG", "Hi, Dios", "Hello, water purifier", "Hello, refrigerator".

Thereafter, the voice recognition module may recognize the input wake-up word to output a wake-up word recognition guide sound through the speaker (S214).

The wake-up word recognition guide sound output from the device may be set to a buzzer sound, such as a "ring ring" or a machine sound or may be set to a voice such as "Please tell me the command you want" or "Hello."

In some examples, in operation S214, a separately provided LED for notification may be turned on or be repeatedly turned on and off.

As described above, after the wake-up word recognition guide sound is output, the microphone and the voice recognition module stand by the command word recognition that is provided in the form of a voice spoken by the user (S215).

Here, the command word may correspond to a 'water discharge amount' or a 'water discharge temperature,' which are desired by the user.

In the standby state as described above (S215), the user speaks the desired water discharge conditions through voice (S216).

Then, the desired water discharge condition provided in the form of the voice spoken by the user is input to the microphone and the voice recognition module (S217).

For example, the user may speak the desired amount of water such as '50 ml,' '100 ml,' and '300 ml.'

As another example, the user may speak the desired water discharge temperature such as 'hot water,' 'cold water,' 'purified water,' 'very hot water,' 'very cold water,' and the like.

Thereafter, in the voice recognition module, the 'desired water discharge condition' input in operation S217 is recognized, and the water discharge condition recognition guide sound is output through the speaker (S218).

The 'water discharge amount recognition guide sound' output from the device is set to a buzzer sound such as a "ring ring" or a mechanical sound or set to a guide sound such as "I will discharge 50 ml of purified water" or "Water discharge proceeds."

In some examples, in operation S218, when the desired water discharge amount of the desired water discharge conditions provided in the form of voice spoken from the user is within the preset low capacity, the controller may be configured to output a first guide sound through the speaker, and when the desired water discharge amount of the desired water discharge conditions provided in the form of voice spoken from the user is within the preset high capacity, the controller may be configured to output a second guide sound different from the first guide sound through the speaker.

For example, the desired water discharge amount of 120 ml or less may be set to be included in the low capacity, and the desired water discharge amount exceeding 120 ml may be set to be included in the high capacity.

Then, when the user speaks the desired low-capacity water discharge amount in operation S216, a first guide sound such as "start the water discharge," "Please check the cup," "120 ml of purified water (or cold water) is dispensed," and the like may be output in operation S218.

In some examples, when the user speaks a desired high-capacity water discharge amount in operation S216, a second guide sound such as "Please check if a large container is placed," "Please check the size of the cup," "500 ml (or 1000 ml) of purified water (or cold water)," and the like may be output in operation S218. Thus, when the high-capacity water is discharged, the user may check a size of the container once again, and when the high-capacity water is discharged, an accidental overflow of the container may be prevented.

In some examples, in operation S218, a separately provided LED for notification may be turned on or be repeatedly turned on and off.

For example, when the user commands the discharge of "100 ml of hot water," the LED disposed at a position on which the hot water is displayed and the LED disposed at a position on which 100 ml is displayed may be turned on.

Then, the controller drives the elevation motor 250 to allow the second elevation cover 210 and the water discharge nozzle 240 to descend (S219).

After operation S219, a sensing sensor 620 senses whether a touch bar 610 and the water intake container contact each other (S220).

The second elevation cover 210 and the water discharge nozzle 240 descend until the touch bar 610 and the sensing sensor 620 sense the upper end of the container.

If the upper end of the container is not sensed by the sensor 600, the second elevation cover 210 and the water discharge nozzle 240 descend up to the lowermost end (S221).

In some examples, when it is determined that the second elevation cover 210 and the water discharge nozzle 240 reach the bottom dead point in this manner, the controller 140 may stop the driving of the elevation motor 250 to stop the descending of the second elevation cover 210 and the water discharge nozzle 240 (S222).

For example, as described above, while the second elevation cover 210 and the water discharge nozzle 240 reach the lowermost end, or the touch bar 610 contacts the upper end of the water intake container, when the sensing sensor 620 senses the water intake container, water discharge proceeds immediately (S224).

As another example, when the second elevation cover 210 and the water discharge nozzle 240 descend, while the touch bar 610 contacts the upper end of the water intake container, when the water intake container is sensed by the sensing sensor 620, the water discharge may not immediately proceed, and the second elevation cover 210 and the water discharge nozzle 240 may ascend by a set height (S223).

Thereafter, the water discharge proceeds (S224).

In detail, while a water discharge valve is opened, water within a water discharge pipe 400 is discharged to the water discharge nozzle 240.

Here, the dispensed water may correspond to purified water, cold water or hot water depending on user's selection or setting.

Then, while the water discharge proceeds, it is determined whether a water discharge stop command is spoken from the user (S225).

For example, when a wake-up word or a command word such as "stop it" or "stop" is spoken by the user, the water discharge is terminated.

In some examples, if the water stop command is not spoken by the user, it is determined whether the water discharge proceeds, and the amount of water discharged reaches the target flow rate (S226).

In operation S226, when the water flow rate reaches the target flow rate, the water discharge valve is closed to terminate the water discharge (S227).

Then, the controller 140 may drive the elevation motor 250 to allow the second elevation cover 210 and the water discharge nozzle 240 to ascend to their original positions (S230).

Here, the original positions may refer to positions of the second elevation cover 210 and the water discharge nozzle 240 in the standby state (S211).

Here, the ascending of the second elevation cover 210 and the water discharge nozzle 240 may be performed after a predetermined time after the water discharge is terminated.

For example, when the water discharge is terminated, after waiting for about 6 seconds, the second elevation cover 210 and the water discharge nozzle 240 may ascend.

When the water discharge is terminated, the controller 140 determines whether an additional water discharge command is spoken (S228).

For example, in operation S228, when the additional water discharge command such as "One more glass" is spoken from the user, the process returns to operation S224, and thus, the additional water discharge proceeds.

In some examples, when the additional water discharge command is not spoken after the water discharge is terminated, it is determined whether a set time elapses after the water discharge is terminated (S229).

If the additional water discharge command is not spoken, and the set time elapses, while the elevation motor 250 operates, the second elevation cover 210 and the water discharge nozzle 240 ascend (S230).

Then, when the second elevation cover 210 and the water discharge nozzle 240 reach a top dead point, the operation of the elevation motor 250 is stopped, and the ascending operation of the second elevation cover 210 and the water discharge nozzle 240 is stopped.

Hereinafter, a method for controlling the water discharge device will be described with reference to FIG. 19.

First, in the microphone and the voice recognition module, recognition of a wake-up word stands by (S211).

In the standby state as described above, the user speaks the wake-up word by voice (S212).

Then, the wake-up word spoken by the user is input to the microphone and the voice recognition module (S213).

Here, the wake-up word input to the device may be set to "Hi, LG", "Hi, Dios", "Hello, water purifier", "Hello, refrigerator".

Thereafter, the voice recognition module may recognize the input wake-up word to output a wake-up word recognition guide sound through the speaker (S214).

The 'wake-up word recognition guide sound' output from the device may be set to a buzzer sound, such as a "ring ring" or a machine sound or may be set to a voice such as "Please tell me the command you want" or "Hello."

In some examples, in operation S214, a separately provided LED for notification may be turned on or be repeatedly turned on and off.

As described above, after the wake-up word recognition guide sound is output, the microphone and the voice recognition module stand by the command word recognition that is provided in the form of a voice spoken by the user (S215).

Here, the command word may correspond to a 'water discharge amount' or a 'water discharge temperature,' which are desired by the user.

In the standby state as described above (S215), the user speaks the desired water discharge conditions through voice (S216).

Then, the desired water discharge condition provided in the form of the voice spoken by the user is input to the microphone and the voice recognition module (S217).

For example, the user may speak the desired amount of water such as '50 ml,' '100 ml,' and '300 ml'

As another example, the user may speak the desired water discharge temperature such as 'hot water,' 'cold water,' 'purified water,' 'very hot water,' 'very cold water,' and the like.

Thereafter, in the voice recognition module, the 'desired water discharge condition' input in operation S217 is recognized, and the water discharge condition recognition guide sound is output through the speaker (S218).

The 'water discharge amount recognition guide sound' output from the device is set to a buzzer sound such as a "ring ring" or a mechanical sound or set to a guide sound such as "I will discharge 50 ml of purified water" or "Water discharge proceeds."

In some examples, in operation S218, when the desired water discharge amount of the desired water discharge conditions provided in the form of voice spoken from the user is within the preset low capacity, the controller may be configured to output a first guide sound through the speaker, and when the desired water discharge amount of the desired water discharge conditions provided in the form of voice spoken from the user is within the preset high capacity, the controller may be configured to output a second guide sound different from the first guide sound through the speaker.

For example, the desired water discharge amount of 120 ml or less may be set to be included in the low capacity, and the desired water discharge amount exceeding 120 ml may be set to be included in the high capacity.

Then, when the user speaks the desired low-capacity water discharge amount in operation S216, a first guide sound such as "start the water discharge," "Please check the cup," "120 ml of purified water (or cold water) is dispensed," and the like may be output in operation S218.

In some examples, when the user speaks a desired high-capacity water discharge amount in operation S216, a second guide sound such as "Please check if a large container is placed," "Please check the size of the cup," "500 ml (or 1000 ml) of purified water (or cold water)," and the like may be output in operation S218. Thus, when the high-capacity water is discharged, the user may check a size of the container once again, and when the high-capacity water is discharged, an accidental overflow of the container may be prevented.

In some examples, in operation S218, a separately provided LED for notification may be turned on or be repeatedly turned on and off.

For example, when the user commands the discharge of "100 ml of hot water," the LED disposed at a position on which the hot water is displayed and the LED disposed at a position on which 100 ml is displayed may be turned on.

Then, the controller drives the elevation motor 250 to allow the second elevation cover 210 and the water discharge nozzle 240 to descend (S219).

After operation S219, a sensing sensor 620 senses whether a touch bar 610 and the water intake container contact each other (S220).

The second elevation cover 210 and the water discharge nozzle 240 descend until the touch bar 610 and the sensing sensor 620 sense the upper end of the container.

If the upper end of the container is not sensed by the sensor 600, the second elevation cover 210 and the water discharge nozzle 240 descend up to the lowermost end (S221).

In some examples, when it is determined that the second elevation cover 210 and the water discharge nozzle 240 reach the bottom dead point in this manner, the controller 140 may stop the driving of the elevation motor 250 to stop the descending of the second elevation cover 210 and the water discharge nozzle 240 (S222).

In operation S222, the controller may be configured to output the guide sound through the speaker when the sensor does not contact the container in the state in which the second elevation cover reaches the bottom dead point. The guide sound may include comments such as "Please check the cup," "Please release the cup," "No cup," and the like.

For example, in operation S222, when the second elevation cover 210 and the water discharge nozzle 240 reach the lowermost end, the water discharge may proceed immediately.

As another example, in operation S222, when the second elevation cover 210 and the water discharge nozzle 240 reach the lowermost end, the water discharge may not proceed.

In operation S222, when the second elevation cover 210 and the water discharge nozzle 240 reach the lowermost end, in operation S216, the water discharge amount of the fired water discharge condition is compared with a preset reference capacity (S232).

In operation S232, if the water discharge capacity of the water discharge request condition is greater than or equal to a preset reference capacity, it is determined that it is included in a high capacity range, and when water discharge proceeds without the container, overflowing of the water may occur in the tray, and thus, the water discharge is terminated in the water discharge does not proceeds (S227).

In some examples, in operation S232, if the water discharge capacity of the water discharge request condition is less than the preset reference capacity, it is determined that it is included in the low capacity range, and even if the water discharge proceeds without the container, the overflowing of the water does not occur in the tray, and thus, the water discharge proceeds (S224).

In operation S220, when the second elevation cover 210 and the water discharge nozzle 240 descend, while the touch bar 610 contacts the upper end of the water intake container, when the sensing sensor 620 senses the water intake container, water discharge proceeds immediately (S224).

In some examples, in operation S220, when the second elevation cover 210 and the water discharge nozzle 240 descend, while the touch bar 610 contacts the upper end of the water intake container, when the water intake container is sensed by the sensing sensor 620, the water discharge may not immediately proceed, and the second elevation cover 210 and the water discharge nozzle 240 may ascend by a set height (S223).

Thereafter, the water discharge proceeds (S224).

In detail, while a water discharge valve is opened, water within a water discharge pipe 400 is discharged to the water discharge nozzle 240.

Here, the dispensed water may correspond to purified water, cold water or hot water depending on user's selection or setting.

Then, while the water discharge proceeds, it is determined whether a water discharge stop command is spoken from the user (S225).

For example, when a wake-up word or a command word such as "stop it" or "stop" is spoken by the user, the water discharge is terminated.

In some examples, if the water stop command is not spoken by the user, it is determined whether the water discharge proceeds, and the amount of water discharged reaches the target flow rate (S226).

In operation S226, when the water flow rate reaches the target flow rate, the water discharge valve is closed to terminate the water discharge (S227).

Then, the controller 140 may drive the elevation motor 250 to allow the second elevation cover 210 and the water discharge nozzle 240 to ascend to their original positions (S230).

Here, the original positions may refer to positions of the second elevation cover 210 and the water discharge nozzle 240 in the standby state (S211).

Here, the ascending of the second elevation cover 210 and the water discharge nozzle 240 may be performed after a predetermined time after the water discharge is terminated.

For example, when the water discharge is terminated, after waiting for about 6 seconds, the second elevation cover 210 and the water discharge nozzle 240 may ascend.

When the water discharge is terminated, the controller 140 determines whether an additional water discharge command is spoken (S228).

For example, in operation S228, when the additional water discharge command such as "One more glass" is spoken from the user, the process returns to operation S224, and thus, the additional water discharge proceeds. Here, the water discharge valve may be temporarily closed and then opened again or may be maintained in the opened state.

For reference, in operation S228, it may be determined that the additional water discharge command is spoken from the user just before the water discharge is terminated, after the water discharge is terminated, at a time point at which the water discharge is terminated, and while the water discharge proceeds.

In some examples, when the additional water discharge command is not spoken after the water discharge is terminated, it is determined whether a set time elapses after the water discharge is terminated (S229).

If the additional water discharge command is not spoken, and the set time elapses, while the elevation motor 250 operates, the second elevation cover 210 and the water discharge nozzle 240 ascend (S230).

Then, when the second elevation cover 210 and the water discharge nozzle 240 reach a top dead point, the operation of the elevation motor 250 is stopped, and the ascending operation of the second elevation cover 210 and the water discharge nozzle 240 is stopped.

In some implementations, when the user inputs the use of the water discharge by voice, water suitable for the use may be discharged.

Referring again to FIG. 17, the voice recognition module 120 includes a communication portion communicating with an external server 130, and the communication portion communicates with the external server 130 for a set time, and then, the communication is terminated automatically. For example, in some implementations, the voice recognition module 120 may include one or more electric circuits or devices such as a signal transmitter, a signal receiver, or signal transceiver, which are configured to communicate with a server, a cloud, or another device. In some cases, the voice recognition module 120 may be configured to communicate with the external server 130 and another voice recognition module.

In some implementations, the one or more electric circuits of the voice recognition module 120 may include or be connected to a controller (e.g., controller 140). The controller may include a clock or a timer to determine an elapse of time corresponding to the set time and to terminate the communication between the voice recognition module 120 and the external server 130 based on the elapse of the set time.

The voice recognition module 120 communicates with the external server 130 only for the set time to protect user's personal information and prevent hacking, and then, the communication is terminated.

Referring to FIGS. 18 and 19, in operation S216, when the desired water discharge amount of the desired water discharge condition, which is spoken in the form of voice by the user, is included in the preset low capacity range, in the water discharge process (S224), the voice recognition module 120 may be maintained to communicate with the external server 130.

For example, when the desired water discharge amount is 120 ml or less, it is included in the low dose range.

In some examples, when the voice recognition module 120 is maintained to communicate with the external server 130 as described above, in the state in which the water discharge proceeds, when the user speaks an emergency stop command such as 'stop' or speaks an additional water discharge command such as 'one more glasses,' the controller may recognize the commands.

Here, various speech act words such as the emergency stop command are stored in the external server 130, and also, various speed act words such as the additional water discharge command are stored in the external server 130.

Thus, in the process of the water discharge, when the user speaks the emergency stop command, it may be recognized in real time to terminate the water discharge in emergency.

In some implementations, in the process of the water discharge, when the user speaks the additional water discharge command, it may be recognized in real time, and then, after the water discharge is completed, the additional water discharge may be performed.

In some examples, in operation S216, if the desired water discharge amount of the desired water discharge condition, which is spoken from the user is included in the preset high capacity range, the voice recognition module 120 may be maintained to communicate with the external server for a set time in the water discharge process (S224), and then, the water discharge may be stopped.

For example, the voice recognition module 120 may terminate the communication after communicating with the external server 130 for about 6 seconds.

As another example, when the desired water discharge amount is larger than about 120 ml, it is included in the high-capacity range.

In some examples, when the voice recognition module 120 is maintained to communicate with the external server 130, and then, the communication with the external server 130 is terminated as described above, in the state in which the water discharge proceeds, when the user speaks an emergency stop command such as 'stop' or speaks an additional water discharge command such as 'one more glasses,' the controller may recognize the commands.

Thus, it may be necessary to store various speech act words corresponding to the emergency stop command and various speed act words corresponding to the additional export command in a local memory of the controller 140, but the external server 130.

In some implementations, various speech act words corresponding to the emergency stop command and various speed act words corresponding to the additional export command may be stored in a local memory of the controller 140.

For example, various speech act words corresponding to the emergency stop command such as "stop it," "stop," and the like may be stored in the local memory of the controller 140.

As another example, various speech act words corresponding to the additional water discharge command such as "one or glasses" and the like may be stored in the local memory of the controller 140.

As another example, when the wake-up word is spoken while the water discharge is performed, the voice recognition module 120 may be configured to recognize the wake-up word as the emergency stop command or as the additional water discharge command.

Thus, in the process of the high-capacity water discharge as well as low-capacity, when the user speaks the emergency stop command, the emergency stop command may be recognized in real time to terminate the water discharge in emergency. In the process of the high-capacity water discharge, when the user speaks the additional water discharge command, the additional water discharge may be performed after the water discharge is completed.

As described above, in the state in which the communication with the external server 130 is terminated, when the wake-up word or the set command is spoken, the communication between the voice recognition module 120 and the external server 130 may be resumed.

In some examples, in the state in which the communication with the external server 130 is terminated, when the water discharge is terminated, the communication between the voice recognition module 120 and the external server 130 may be resumed.

Referring again to FIG. 17, the controller 140 may store a table 141 which matches the water discharge use spoken from the user and the water discharge amount and temperature.

As another example, the external server 130 that communicates with the voice recognition module 120 in a Wi-Fi manner may store a table which matches the water discharge use spoken from the user and the water discharge amount and temperature.

In some examples, in operation S214, after the wake-up word recognition guide sound is output through the speaker, in operation S216, the desired water discharge use may be spoken from the user instead of the desired water discharge amount spoken from the user.

For example, the user may speak the desired water discharge use such as "cup ramen for one person," "mix coffee for one cup", "cold water for one cup,' and the like.

As described above, when the desired water discharge use is spoken by the user, the voice recognition module 120 recognizes the input desired water discharge use.

In some examples, the controller 140 compares the desired water discharge use recognized by the voice recognition module with the table stored in the controller 140 or the external server 130 to check the water discharge amount and temperature values matched with the desired water discharge use spoken from the user.

In some examples, the water discharge use recognition guide sound is output through the speaker (S218).

For example, if the user speaks the desired water discharge use such as "cup ramen for one person," and the voice recognition module recognizes the speech act, the controller 140 compares the table stored in the controller 140 or the external server 130 to read the water discharge temperature and amount with respect to the cup ramen for one person.

The temperature of water with respect to the cup ramen for one person, which is stored in the table, may be about 95° C., and the water discharge amount with respect to the cup ramen for one person, which is stored in the table, may be about 250 ml.

Thereafter, the water discharge nozzle may descend, and the water discharge process may proceed.

In some examples, when the discharged water flow rate sensed by the flow sensor reaches the input desired water discharge amount, the discharged water valve may be closed, and the discharged water may be terminated.

What is claimed is:

1. A water discharge device comprising:

a case comprising a front cover, the front cover defining a front surface of the case;

a microphone configured to receive a sound input from a user;

a voice recognition module configured to recognize voice information from the sound input;

a speaker configured to output a guide sound to the user;

a first elevation cover connected to the case;

a second elevation cover configured to move upward relative to a bottom of the case and insert into an inside of the first elevation cover;

an elevation motor connected to the second elevation cover and configured to provide power for operation of the second elevation cover;

a water discharge nozzle disposed at a lower end of the second elevation cover and configured to dispense water;

a water discharge valve configured to regulate a flow of water guided toward the water discharge nozzle;

a flow sensor configured to sense a flow rate of the flow of water guided toward the water discharge nozzle;

a sensor that is disposed at the second elevation cover and has at least a portion exposed to a lower side of the second elevation cover, the sensor being configured to, based on the second elevation cover moving downward toward the bottom of the case, sense whether the sensor contacts a container disposed below the second elevation cover; and a controller configured to control operation of the elevation motor and the water discharge valve.

2. The water discharge device according to claim 1, wherein the controller is configured to stop operation of the elevation motor based on the sensor contacting the container while the second elevation cover moving downward toward the bottom of the case.

3. The water discharge device according to claim 1, wherein the controller is configured to:

based on the sensor contacting the container while the second elevation cover moving downward toward the bottom of the case, control the elevation motor to move the second elevation cover upward to a set height; and control the elevation motor to stop operation of the second elevation cover based on the second elevation cover being moved upward to the set height.

4. The water discharge device according to claim 1, wherein the case further comprises a top cover that defines a top surface of the case, and wherein the voice recognition module, the speaker, and the microphone are disposed vertically below the top cover.

5. The water discharge device according to claim 4, wherein the voice recognition module is disposed adjacent to the front cover, wherein the microphone is disposed rearward relative to the voice recognition module, and wherein the speaker is disposed between the voice recognition module and the microphone.

6. The water discharge device according to claim 1, wherein the controller is configured to control the operation of the elevation motor to move the second elevation cover between a preset top dead point and a preset bottom dead point.

7. The water discharge device according to claim 6, wherein the controller is configured to output the guide sound through the speaker based on a determination that the sensor does not contact the container in a state in which the second elevation cover is at the preset bottom dead point.

8. The water discharge device according to claim 6, wherein the controller is configured to decrease a rotation rate of the elevation motor based on the second elevation cover approaching the preset top dead point or the preset bottom dead point.

9. The water discharge device according to claim 1, wherein the voice recognition module is configured to communicate with an external server, and to terminate communication with the external server based on communicating with the external server for a set time.

10. The water discharge device according to claim 9, wherein the voice recognition module is configured to:

determine a desired water discharge amount from the voice information; and based on the desired water discharge amount being less than a reference amount corresponding to the container, maintain the communication with the external server.

11. The water discharge device according to claim 9, wherein the voice recognition module is configured to:

determine a desired water discharge amount from the voice information; and based on the desired water discharge amount being greater than or equal to a reference amount corresponding to the container, terminate the communication with the external server after communicating with the external server for the set time.

12. A method for controlling a water discharge device including a case, a microphone configured to receive a sound input from a user, a voice recognition module configured to recognize voice information from the sound input, a speaker configured to output a guide sound to the user, a first elevation cover connected to the case, a second elevation cover configured to move upward relative to a bottom of the case and insert into an inside of the first elevation cover, an elevation motor connected to the second elevation cover and configured to provide power for operation of the second elevation cover, a water discharge nozzle disposed at a lower end of the second elevation cover and configured to dispense water, a water discharge valve configured to regulate a flow of water guided toward the water discharge nozzle, a flow sensor configured to sense a flow rate of the flow of water guided toward the water discharge nozzle, a sensor that is disposed at the second elevation cover, that has at least a portion exposed to a lower side of the second elevation cover, and that is configured to, based on the second elevation cover moving downward toward the bottom of the case, sense whether the sensor contacts a container disposed below the second elevation cover, the method comprising:

receiving the sound input from the user through the microphone;

recognizing the voice information from the sound input;

recognizing an input wakeup word from the voice information, and outputting a wakeup word recognition guide sound through the speaker;

recognizing a desired water discharge amount from the voice information, and outputting a desired water discharge condition recognition guide sound through the speaker;

moving the second elevation cover downward toward the bottom of the case by operating the elevation motor;

detecting whether the sensor contacts an upper end of the container;

stopping operation of the elevation motor to stop a downward movement of the second elevation cover;

opening the water discharge valve to discharge water; and closing the water discharge valve to terminate discharge of water based on an amount of discharged water corresponding to the desired water discharge amount, the amount of discharged water being determined based on the flow rate detected by the flow sensor.

13. The method according to claim 12, further comprising:

controlling the elevation motor to move the second elevation cover between a preset top dead point and a preset bottom dead point, and wherein opening the water discharge valve to discharge water comprises:

determining whether the sensor contacts the upper end of the container based on the second elevation cover being positioned at the preset bottom dead point;

comparing the desired water discharge amount with a reference amount corresponding to the container; and based on (i) a determination that the sensor does not contact the upper end of the container and (ii) the desired water discharge amount being less than the reference amount, opening the water discharge valve to discharge water.

14. The method according to claim 12, further comprising:

controlling the elevation motor to move the second elevation cover between a preset top dead point and a preset bottom dead point, and wherein closing the water discharge valve comprises:

determining whether the sensor contacts the upper end of the container based on the second elevation cover being positioned at the preset bottom dead point;

comparing the desired water discharge amount with a reference amount;

based on (i) a determination that the sensor does not contact the upper end of the container and (ii) the desired water discharge amount being greater than or equal to the reference amount, maintaining a closed state of the water discharge valve.

15. The method according to claim 12, further comprising:

based on recognizing an emergency stop command from the voice information while discharging water through the water discharge nozzle, closing the water discharge valve.

16. The method according to claim 12, further comprising:

based on recognizing a repeated water discharge command from the voice information while discharging water or at a time point at which water discharge is terminated, maintaining an open state of the water discharge valve to dispense additional water corresponding to the repeated water discharge command after dispensing the desired water discharge amount of water.

17. The method according to claim 12, further comprising:

comparing the desired water discharge amount with a reference amount corresponding to the container; and based on the desired water discharge amount being greater than or equal to the reference amount, outputting the guide sound through the speaker.

18. The method according to claim 12, further comprising recognizing a desired water discharge temperature.

19. The method according to claim 12, further comprising:

storing information including a desired water discharge use, a water discharge amount corresponding to the desired water discharge use, and a water temperature corresponding to the desired water discharge use;

determining whether the voice information includes the desired water discharge use; and based on a determination that the voice information includes the desired water discharge use, dispensing the stored water discharge amount of water having the stored water temperature corresponding to the desired water discharge use.

20. The method according to claim 12, further comprising:

comparing the desired water discharge amount with a reference amount corresponding to the container;

based on the desired water discharge amount being less than the reference amount, outputting a first guide sound through the speaker; and based on the desired water discharge amount being greater than the reference amount, outputting, through the speaker, a second guide sound that is different from the first guide sound.

* * * * *